US008553926B2

(12) United States Patent
Takewa

(10) Patent No.: US 8,553,926 B2
(45) Date of Patent: Oct. 8, 2013

(54) SPEAKER AND ELECTRONIC DEVICE

(75) Inventor: Hiroyuki Takewa, Osaka (JP)

(73) Assignee: Panasonic Corporation, Osaka (JP)

( * ) Notice: Subject to any disclaimer, the term of this patent is extended or adjusted under 35 U.S.C. 154(b) by 430 days.

(21) Appl. No.: 12/866,789

(22) PCT Filed: Feb. 13, 2009

(86) PCT No.: PCT/JP2009/000569
§ 371 (c)(1),
(2), (4) Date: Aug. 9, 2010

(87) PCT Pub. No.: WO2009/101813
PCT Pub. Date: Aug. 20, 2009

(65) Prior Publication Data

US 2010/0322458 A1 Dec. 23, 2010

(30) Foreign Application Priority Data

Feb. 14, 2008 (JP) ..... 2008-032836

(51) Int. Cl.
*H04R 9/06* (2006.01)

(52) U.S. Cl.
USPC ..... 381/398; 381/386; 381/420

(58) Field of Classification Search
USPC ..... 381/396, 420, 407, 386, 409, 410, 412, 381/423, 400
See application file for complete search history.

(56) References Cited

U.S. PATENT DOCUMENTS 4,322,584 A * 3/1982 Shimada et al. ..... 381/431
6,341,167 B1 * 1/2002 Okuyama et al. ..... 381/407
2001/0011615 A1 8/2001 Iwasa et al.

(Continued)

FOREIGN PATENT DOCUMENTS

EP 1 377 115 1/2004
EP 1 881 734 A1 1/2008

(Continued)

OTHER PUBLICATIONS

International Search Report issued May 19, 2009 in corresponding International Application No. PCT/JP2009/000569.

(Continued)

*Primary Examiner* — Duc Nguyen
*Assistant Examiner* — Phan Le
(74) *Attorney, Agent, or Firm* — Wenderoth, Lind & Ponack, L.L.P.

(57) ABSTRACT

A speaker includes a diaphragm formed as an elongated box-shaped five face body having one open face; an edge for supporting the diaphragm so as to enable vibration of the diaphragm; a voice coil wound around and fixed to four side faces which are among the five faces of the diaphragm and which are adjacent to the open face; and a magnetic circuit for supplying a drive force to the voice coil. The diaphragm is configured such that a height from the open face to an upper face opposed to the open face is greater than or equal to twice a thickness of the voice coil, and a length of a long side of the upper face is greater than or equal to twice a length of a short side of the upper face, and the upper face and two side faces of the diaphragm define a long side direction of the diaphragm. Additionally, reinforcing ribs are formed as recessed and projecting shapes on the upper face and the two side faces of the diaphragm.

13 Claims, 28 Drawing Sheets

(56) References Cited

U.S. PATENT DOCUMENTS

| | | | | |
|---|---|---|---|---|
| 2003/0021435 | A1 | 1/2003 | Nakaso | |
| 2004/0146174 | A1* | 7/2004 | Iwasa et al. | 381/396 |
| 2007/0140521 | A1* | 6/2007 | Mitobe et al. | 381/420 |
| 2007/0165902 | A1 | 7/2007 | Matsumura et al. | |

FOREIGN PATENT DOCUMENTS

| | | |
|---|---|---|
| JP | 31-10358 | 12/1956 |
| JP | 55-157397 | 11/1980 |
| JP | 4-639 | 1/1992 |
| JP | 2000-217192 | 8/2000 |
| JP | 2002-152881 | 5/2002 |
| JP | 2003-47089 | 2/2003 |
| JP | 2004-32659 | 1/2004 |
| JP | 2007-104626 | 4/2007 |
| JP | 2007-104633 | 4/2007 |
| JP | 2007-306203 | 11/2007 |

OTHER PUBLICATIONS

Extended European Search Report issued Jan. 4, 2013 in European Application No. 09 71 0183.

* cited by examiner (a)

(b)

SPEAKER AND ELECTRONIC DEVICE

BACKGROUND OF THE INVENTION

1. Technical Field

The present invention relates to a speaker, and more particularly to a speaker which may be slim and have a reduced thickness.

2. Background Art

In recent years, since high-definition televisions, wide-screen televisions, and the like are widespread, horizontally elongated television screens are becoming common. Further, since living spaces are relatively small in Japan, television sets are required to have reduced widths and thicknesses as a whole.

In general, speaker units (hereinafter, simply referred to as speakers) for use in a television are mounted lateral to both sides of its cathode-ray tube, and this is a cause of increasing the horizontal width of a television set. Therefore, conventionally, speakers having elongated structures such as rectangle-shaped structures and ellipse-shaped structures are used as speakers for televisions. Further, since cathode-ray tubes have become horizontally elongated, it is necessary to increase reduction of the horizontal widths of speakers. Simultaneously, a speaker is required to output an enhanced quality of sound and voice so as to correspond to a screen which enables an enhanced quality of image to be displayed. In addition, since thin-screen televisions for which plasma displays or liquid crystal displays are used become widespread, speakers are required to become slimmer and have further reduced thicknesses.

A conventional elongated (slim-type) speaker will be described. FIG. 37 is a diagram illustrating a configuration of a conventional slim-type speaker 900. FIG. 37(*a*) is a plan view of the conventional slim-type speaker 900. FIG. 37(*b*) is a cross-sectional view of the conventional slim-type speaker 900 in a long side direction (along c-c'). FIG. 37(*c*) is a cross-sectional view of the conventional slim-type speaker 900 in a short side direction (along o-o'). As shown in FIG. 37, the conventional slim-type speaker 900 includes a magnet 901, a plate 902, a yoke 903, a frame 904, a voice coil bobbin 905, a voice coil 906, a damper 907, a diaphragm 909, a dust cap 910, and an edge 911.

The voice coil 906 is a wound lead wire formed of copper, aluminum or the like, and is fixed to the voice coil bobbin 905 having a cylindrical shape. The voice coil bobbin 905 supports the voice coil 906 such that the voice coil 906 is disposed in a magnetic gap 908 formed by the magnet 901, the plate 902, and the yoke 903. Further, the voice coil bobbin 905 is connected to the frame 904 via the damper 907. Furthermore, the voice coil bobbin 905 is adhered to the diaphragm 909 having an ellipsoidal shape or an almost ellipsoidal shape, on a side opposite to a side on which the voice coil 906 is fixed thereto. The dust cap 910 having an almost semicircular cross section is fixed to the center portion of the diaphragm 909. The edge 911 has an annular shape, and has a semicircular cross section. Further, the inner periphery of the edge 911 is fixed to the outer periphery of the diaphragm 909. The outer periphery of the edge 911 is fixed to the frame 904.

When the conventional slim-type speaker 900 is driven, a drive current is applied to the voice coil 906. In this case, due to the drive current applied to the voice coil 906 and an effect of a magnetic field generated around the voice coil 906, the voice coil bobbin 905 performs piston movement. Thus, the diaphragm 909 vibrates in the direction in which the voice coil bobbin 905 performs the piston movement. As a result, a sound wave is emitted from the diaphragm 909. The conventional slim-type speaker 900 as shown in FIG. 37 is disclosed in, for example, Patent Document 1. FIG. 38 is a diagram illustrating a relationship between a reproduced-sound pressure level and a frequency characteristic, which is observed when 1 W of electric power is supplied to the conventional slim-type speaker 900. In FIG. 38, the vertical axis represents reproduced-sound pressure levels, and the horizontal axis represents drive frequencies. A microphone for measuring the reproduced-sound pressure levels as shown in FIG. 38 is disposed, on the central axis of the slim-type speaker 900, in front of the slim-type speaker 900 so as to be distant therefrom by 1 m.

Patent Document 1: Japanese Laid-Open Patent Publication No. 2004-32659

SUMMARY OF THE INVENTION

However, the conventional slim-type speaker 900 described above has the following problems. As shown in FIG. 37, since a driving method, in which the diaphragm 909 having an elongated structure is driven at the center portion thereof, is used for the conventional slim-type speaker 900, resonances are likely to occur in the long side direction of the diaphragm 909. As a result, the reproduced-sound pressure level represents a frequency characteristic in which peak dips occur in intermediate to high sound reproduction bandwidths, thereby deteriorating a sound quality. For example, the characteristic shown in FIG. 38 is such that distinguished dips occur at about 2 kHz, 3 kHz, and 5 kHz.

Therefore, in order to solve the aforementioned problems, an object of the present invention is to provide a speaker which: has a slim structure (an elongated structure); prevents easy occurrence of resonances; and realizes a flat frequency characteristic over a wide bandwidth, so as to enhance a sound quality.

In order to solve the aforementioned problems, a speaker according to the present invention includes: a diaphragm formed as an elongated box-shaped five face body having one open face; an edge for supporting the diaphragm so as to enable vibration of the diaphragm; a voice coil wound around and fixed to four side faces which are among five faces of the diaphragm and which are adjacent to the open face; and a magnetic circuit for supplying a drive force to the voice coil, and the diaphragm is configured such that a height from the open, face to an upper face opposed to the open face is greater than or equal to twice a thickness of the voice coil, and a length of a long side of the upper face is greater than or equal to twice a length of a short side of the upper face, and the upper face and two side faces of the diaphragm define a long side direction of the diaphragm, and a plurality of reinforcing ribs are formed as recessed and projecting shapes on the upper face and the two side faces of the diaphragm.

Further, it is preferable that a flange is provided around the four side faces adjacent to the open face of the diaphragm, and the voice coil is fixed to the flange as well as the four side faces.

Further, at least one connection wall may be provided inside the diaphragm.

Further, the edge may be formed of a sheet having a cross section of an arc shape, and a thickness of the edge may be gradually increased from a center of the arc shape toward end portions of the arc shape.

Further, the edge may be made of a material different from a material of the diaphragm.

Further, the edge may be formed of a foamed rubber or a high molecular weight elastomer, and the diaphragm may be formed of a polyimide resin or a pulp.

Further, it is preferable that the magnetic circuit includes one inner magnetic pole having a rectangular parallelepiped shape, and two outer magnetic poles each having a rectangular parallelepiped shape, the one inner magnetic pole is disposed adjacent to the open face of the diaphragm, and the two outer magnetic poles are disposed lateral to both sides, respectively, of the diaphragm.

Further, at least one damper, connected to the upper face opposed to the open face of the diaphragm, for supporting the diaphragm so as to enable vibration of the diaphragm may be further provided, and the edge may be connected to end portions of the four side faces adjacent to the open face of the diaphragm to support the diaphragm, and the end portions are adjacent to the open face of the diaphragm.

Further, the at least one damper may be formed of a sector-shaped sheet having an arc-shaped cross section.

Further, the at least one damper may be formed of a rectangular sheet having an arc-shaped cross section.

Further, a plurality of dampers, each connected to the upper face opposed to the open face of the diaphragm, for supporting the diaphragm so as to enable vibration of the diaphragm may be further provided, and the plurality of dampers may support the diaphragm such that at least two of the plurality of dampers each have one end portion connected to the upper face opposed to the open face of the diaphragm at a same one position, and each have the other end portion oriented toward a different direction.

Further, the present invention may be used as an electronic equipment (typically, a television broadcast receiver) including the speaker described above.

According to the present invention, it is possible to provide a speaker which is of a slim type, and which is less likely to cause resonances, and enables a flat frequency characteristic over a wide bandwidth, to enhance a sound quality. Further, according to the present invention, it is possible to provide a speaker having a reduced thickness.

DESCRIPTION OF THE REFERENCE CHARACTERS

Figure 1:
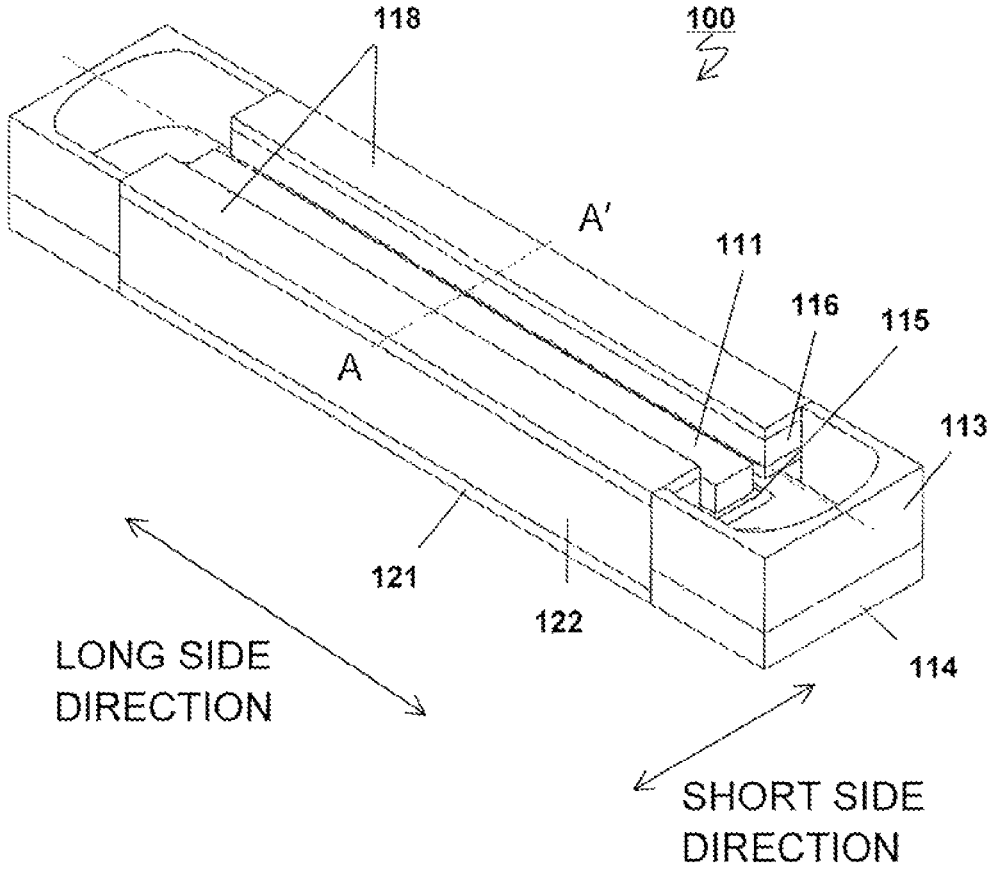
FIG. 1 is a perspective view of an example of a speaker 100 according to a first embodiment.

100, 200, 300, 400, 900 speaker
101, 201 box-shaped five face body
103 inverse-L-shaped flange
111, 211, 909 diaphragm
112, 312, 911 edge
113, 114, 904 frame
115, 906 voice coil
116, 117, 901 magnet
118, 121, 122, 903 yoke
119, 120, 902 plate
150, 250, 350, 450 vibration system
235 reinforcing rib
250-1, 250-2, 250-3 model
356 projection
362 connection wall
366 gap
471, 907 damper
473 damper base
905 voice coil bobbin
910 dust cap

DETAILED DESCRIPTION OF THE INVENTION

First Embodiment

FIG. 1 is a perspective view of an example of a speaker 100 according to a first embodiment. The speaker 100 of the first embodiment has distinguished feature that the speaker 100 has an elongated (slim) shape, and a driven portion of a diaphragm is enlarged, and the diaphragm has an enhanced rigidity.

Figure 2:
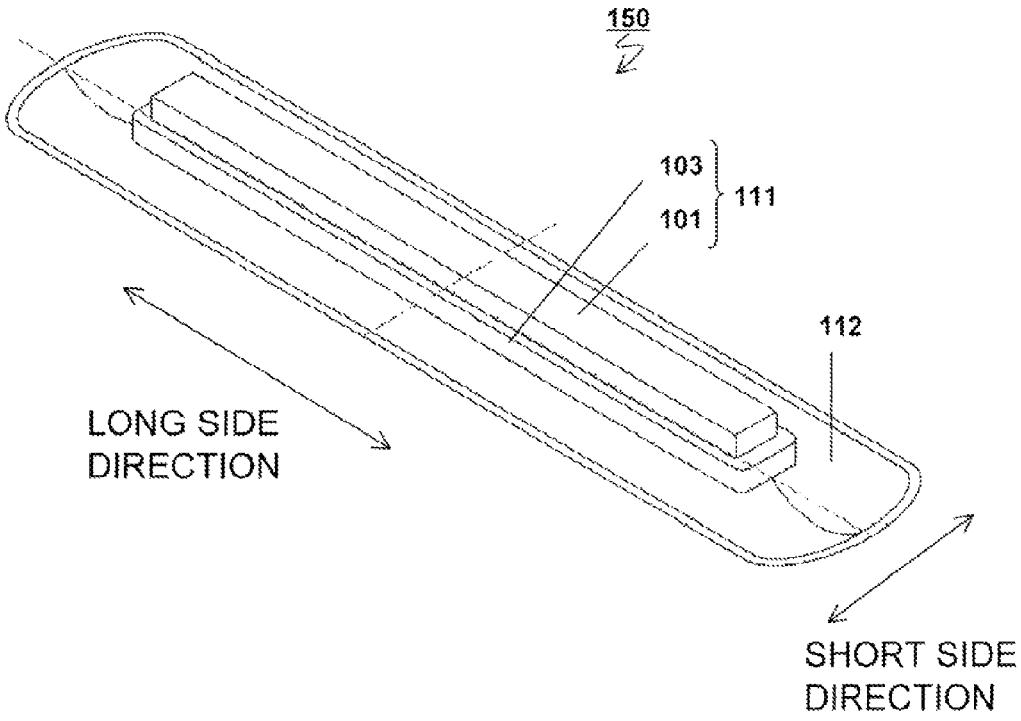
FIG. 2 is a diagram illustrating a vibration system 150 of the speaker 100 according to the first embodiment.
Figure 3:
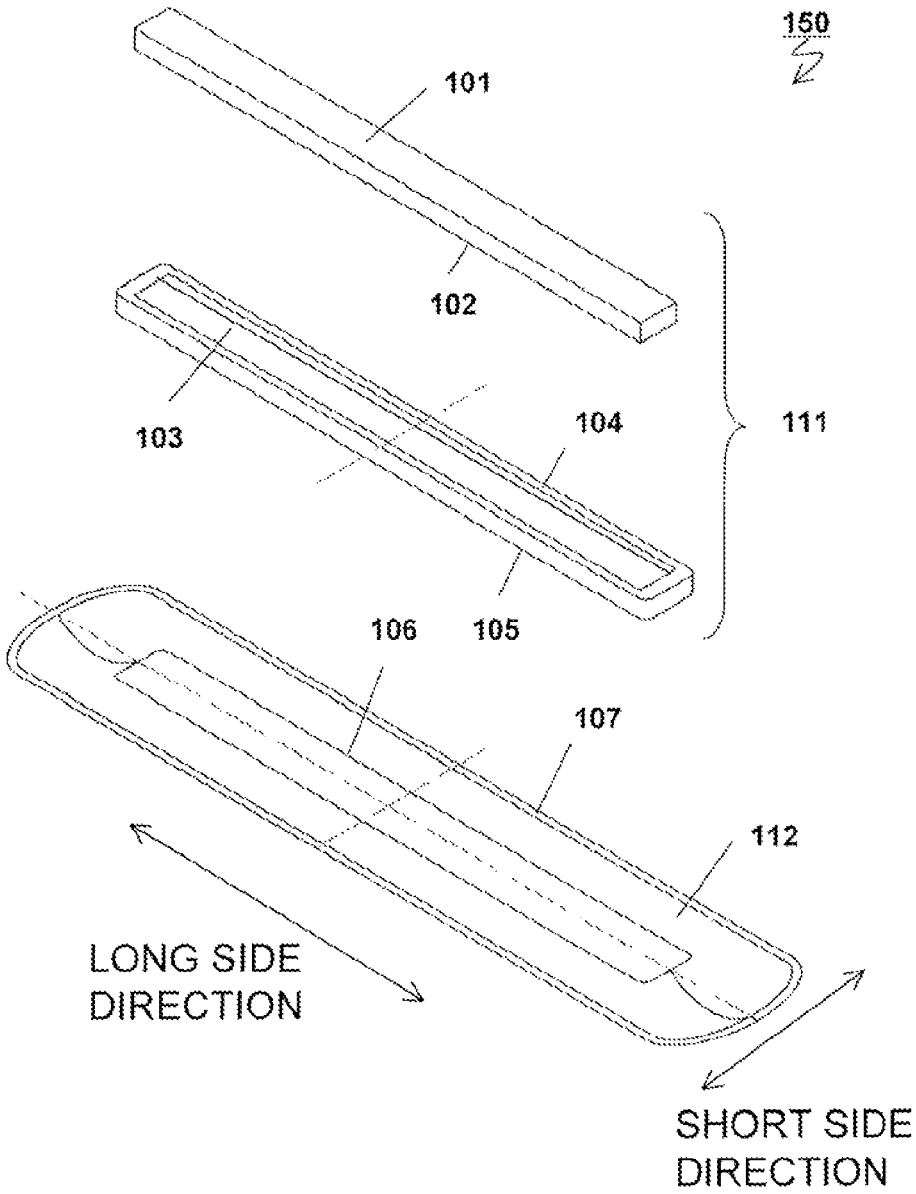
FIG. 3 is a diagram illustrating components of the vibration system 150 of the speaker 100.
Figure 4:
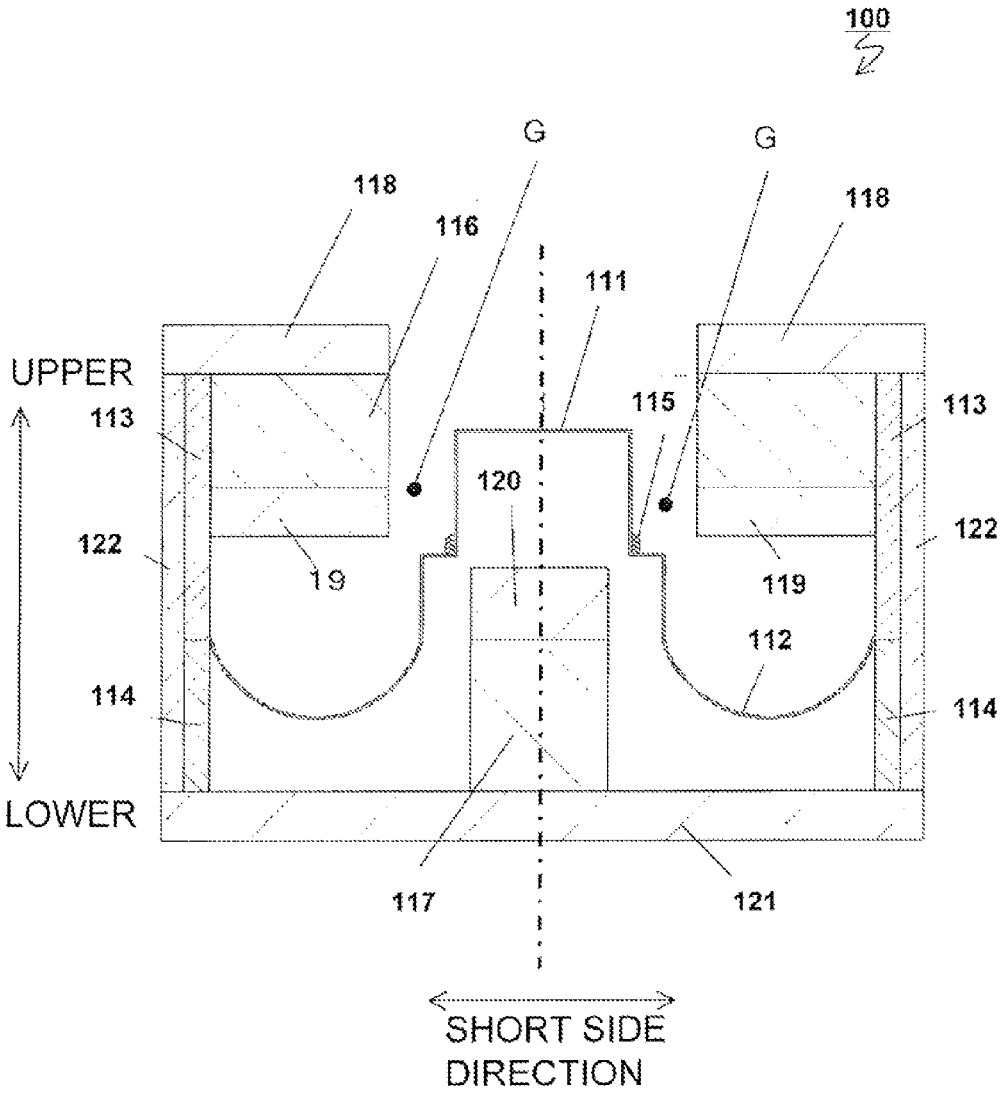
FIG. 4 is a diagram illustrating a cross section of the speaker 100 shown in FIG. 1 along A-A'.

FIG. 2 is a diagram illustrating a vibration system 150 of the speaker 100 according to the first embodiment. FIG. 3 is a diagram illustrating components of the vibration system 150 of the speaker 100. FIG. 4 is a diagram illustrating a cross section of the speaker 100 shown in FIG. 1 along A-A'. As shown in FIG. 1 and FIG. 4, the speaker 100 includes: a diaphragm 111; an edge 112; upper frames 113; lower frames 114; a voice coil 115; upper magnets 116; a lower magnet 117; upper yokes 118; upper plates 119; a lower plate 120; a lower yoke 121; and side yokes 122. Further, as shown in FIG. 1, the speaker 100 has an elongated shape in which the longitudinal length thereof is unequal to the transverse length thereof.

Figure 5:
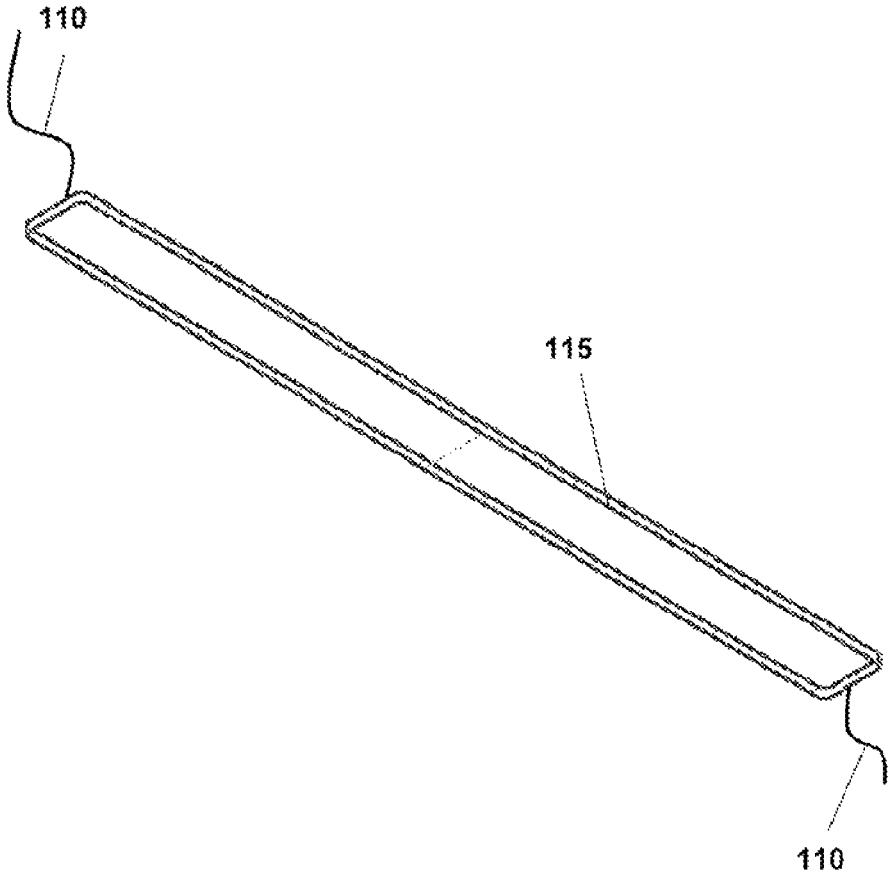
FIG. 5 is a diagram illustrating a voice coil 115 of the speaker 100.

Firstly, the configuration of the vibration system 150 of the speaker 100 will be described. As shown in FIG. 2 and FIG. 3, the vibration system 150 includes the diaphragm 111 and the edge 112. The diaphragm 111 has an elongated shape, and a ratio of the longitudinal length to the transverse length is preferably 2 or more:1. In other words, when the longitudinal length of the diaphragm 111 is 1, the transverse length thereof is preferably less than or equal to 0.5. Hereinafter, as shown in FIG. 2, the longitudinal direction of the diaphragm 111 is referred to as a long side direction while the transverse direction thereof is referred to as a short side direction. The diaphragm 111 includes a box-shaped five face body 101 and an inverse-L-shaped flange 103. The shape of the box-shaped five face body 101 is formed by removing, from an elongated rectangular parallelepiped box, one of rectangular faces which extend along the long side direction thereof. The removed face may be referred to as an open face. The inverse-L-shaped flange 103 has an L-shaped cross section (see FIG. 4), and has an elongated shape similarly to the box-shaped five face body 101. The inverse-L-shaped flange 103 is fixed to an open portion 102 of the box-shaped five face body 101. FIG. 5 is a diagram illustrating the voice coil 115 of the speaker 100. The voice coil 115 is fixed to a plane portion 104 (see FIG. 3) of the inverse-L-shaped flange (see FIG. 4). An inner periphery portion 106 of the edge 112 is connected to a lower edge portion 105 (see FIG. 3) of the inverse-L-shaped flange 103. The edge 112 has an elongated annular shape, and is a roll edge (see FIG. 4) having a cross section of an almost semicircular shape (arc shape). The direction toward which the edge 112 projects is opposite to the direction toward which the diaphragm 111 projects. The outer periphery portion 107 (see FIG. 3) of the edge 112 is fixed to and between the upper frames 113 and the lower frames 114 (see FIG. 4). Each of the upper frames 113 and the lower frames 114 has an almost rectangular parallelepiped shape.

Material of the diaphragm 111 and the edge 112 is a polyimide resin, PEN resin or the like. A polymer film which has a reduced thickness ranging from 50 μm to several hundred μm is preferably selected. The vibration system 150 shown in FIG. 2 is formed as a continuously integrated shape by the polymer film being integrally formed through vacuum forming or the like. Alternatively, the vibration system 150 may be formed as a continuously integrated shape by the polymer film being integrally molded through injection molding or the like.

Next, the entire configuration of the speaker 100 will be described by mainly using FIG. 1 and FIG. 4. As shown in FIG. 4, the lower plate 120 is disposed below the open portion 102 of the box-shaped five face body 101 of the diaphragm 111 so as to form a space therebelow, and the lower magnet 117 is fixed to and under the lower plate 120, and the lower yoke 121 is in turn fixed to and under the lower magnet 117. In this manner, the lower plate 120, the lower magnet 117, and the lower yoke 121 are disposed so as to extend toward a direction opposite to a direction toward which the diaphragm 111 projects. The lower yoke 121 extends in the short side direction of the diaphragm 111, and is fixed to the lower frames 114. Each upper plate 119 is disposed above the edge 112 so as to form a space therebetween. The upper magnets 116 are fixed to and on the upper plates 119, respectively, and the upper yokes 118 are fixed to and on the upper magnets 116, respectively, and the upper yokes 118 are fixed to the upper frames 113, respectively. The upper yokes 118 and the lower yoke 121 are magnetically connected through the side yokes 122. A magnetic flux is generated in a magnetic gap G as shown in FIG. 4 by a magnetic circuit including the lower plate 120 and the upper plates 119 which are configured as described above. The upper magnets 116 and the lower magnet 117 each have a rectangular shape as viewed from above, similarly to the diaphragm 111. The upper magnets 116 are disposed such that the direction of the long side of each upper magnet 116 coincides with the long side direction of the diaphragm 111. Similarly, the lower magnet 117 is disposed such that the direction of the long side of the lower magnet 117 coincides with the long side direction of the diaphragm 111. Further, for the magnetic circuit described above, the lower plate 120 and the lower magnet 117 may be referred to as an inner magnetic pole while the upper plates 119 and the upper magnets 116 may be referred to as an outer magnetic pole.

Figure 37:
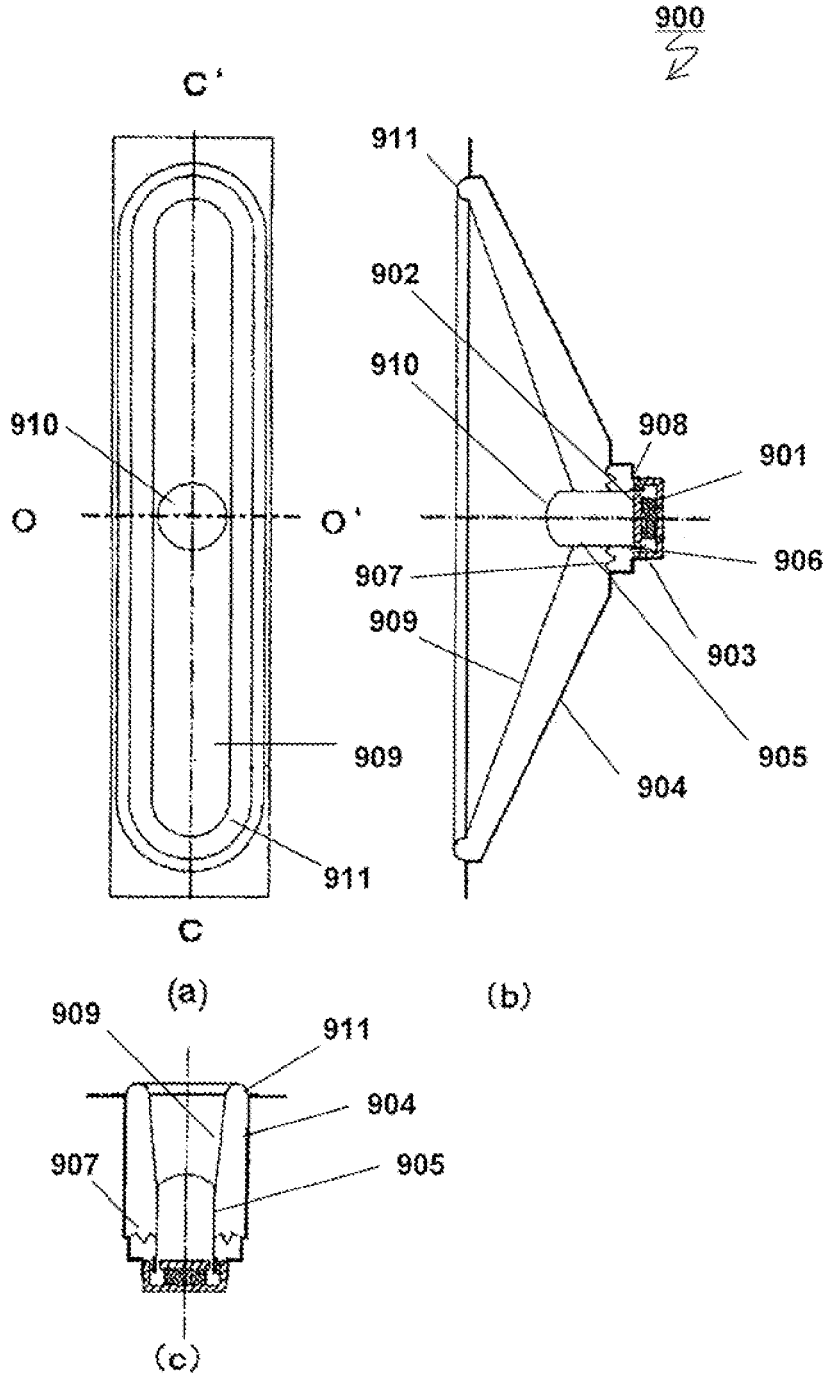
FIG.37 PRIOR ART
FIG. 37 is a diagram illustrating a configuration of a conventional slim-type speaker 900.

The voice coil 115 shown in FIG. 5 is fixed to the diaphragm 111 as shown in FIG. 4. As shown in FIG. 5, the voice coil 115 has a rectangular shape as viewed from above. The voice coil 115 is wound and fixed around a stepped portion on the outer periphery of the diaphragm 111 such that the central axis of the voice coil 115 coincides with the central axis of the diaphragm 111. More specifically, the voice coil 115 is fixed to both the lower portion of the side faces of the box-shaped five face body 101 and the plane portion 104 of the inverse-L-shaped flange 103, by using, for example, an adhesive. The height of the box-shaped five face body 101 is at least twice greater than the thickness (height) of the voice coil 115. Therefore, the voice coil 115 can be disposed at or around the vertically center position of the vibration system 150 as shown in FIG. 4. More specifically, the voice coil 115 can be disposed at or around the center position between the top of the box-shaped five face body 101 and the projecting top of the edge 112. In a typical speaker like the conventional slim-type speaker 900 as shown in FIG. 37, a voice coil is disposed at or below the lower portion of a diaphragm. Leads 110 are provided at both ends, respectively, of the voice coil 115 (see FIG. 5), and the leads 110 are connected through a space to input terminals (not shown) provided on, for example, the upper frames 113, respectively. A drive current is supplied to the leads 110. As shown in FIG. 4, the diaphragm 111 is disposed in the magnetic gap G by the edge 112 being supported and held between the upper frames 113 and the lower frames 114. Further, the edge 112 has an enhanced flexibility. Moreover, as described above, the voice coil 115 is fixed to the diaphragm 111. Thus, the diaphragm 111 vibrates due to a drive force which is generated for the voice coil 115 by a current being applied to the voice coil 115, so that a sound wave is emitted into a space to reproduce a sound and voice.

A preferable example of dimensions of each of the vibration system 150 and the voice coil 115 which enable the speaker 100 to make an output equivalent to an output from a round speaker having the diameter of 8 cm will be specifically described below. In this case, the diameter of a copper wire used for the voice coil 115 is typically about Ø0.1 mm to Ø0.2 mm. Therefore, the width of a bundle of the wound copper wire of the voice coil 115 is about 0.5 mm when the copper wire is wound in two layers. The width of the plane portion 104 of the inverse-L-shaped flange 103 is preferably greater than or equal to the width of the wound wire of the voice coil 115. Therefore, the plane portion 104 of the inverse-L-shaped flange 103 may have the reduced width ranging from about 0.5 mm to 1 mm. In order to cause the speaker 100 to make an output equivalent to an output from a round speaker having the diameter of 8 cm, the length of the short side of the box-shaped five face body 101 is preferably 7 mm, and the length of the long side thereof is preferably 120 mm. Further, the length of the short side of the edge 112 is preferably 20 mm, and the length of the long side thereof is preferably 140 mm. As described above, the width of the plane portion 104 of the inverse-L-shaped flange 103 is small, and therefore the length of the long side of the diaphragm 111 is almost equal to the length of the long side of the box-shaped five face body 101. When the dimensions are as described above, the length of the long side of the box-shaped five face body 101 is 85.7% of the length of the long side of the vibration system 150.

In the speaker 100 having the configuration described above, the diaphragm 111 is driven entirely along the long side direction, and is driven at the end portion in the short side direction. Further, the configuration described above enables suppression of resonance of the diaphragm 111 in the speaker 100. The resonance suppression effect for the diaphragm 111 in the speaker 100 will be described below.

Figure 38:
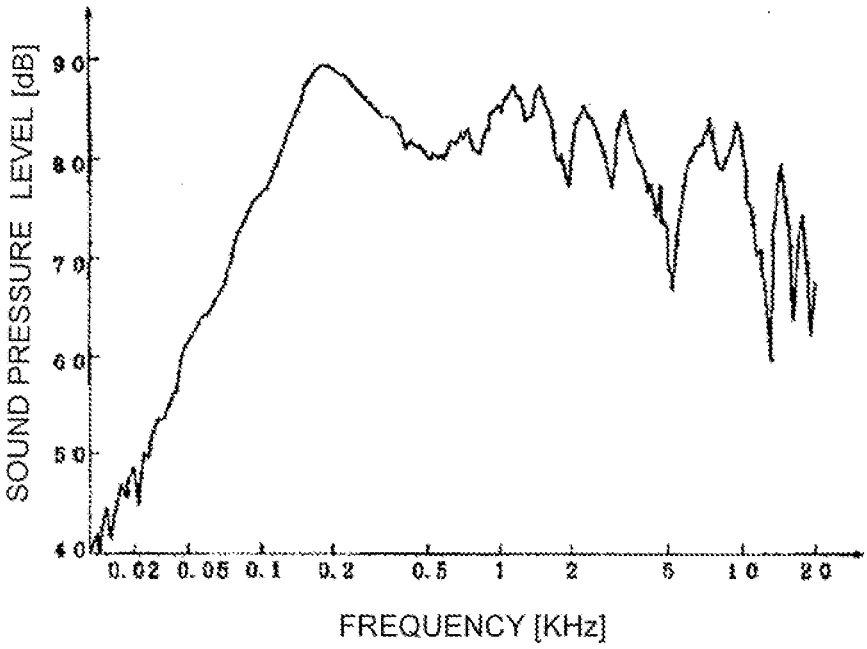
FIG.38 PRIOR ART
FIG. 38 is a diagram illustrating a relationship between a reproduced-sound pressure level and a frequency characteristic, which is observed when 1 W of electric power is supplied to the conventional slim-type speaker 900.

Firstly, the resonance suppression effect for the long side direction of the diaphragm 111 will be described. If the diaphragm 111 is driven centrally at only one point in the same manner as that for the conventional slim-type speaker 900, multiple resonances are induced, and the sound pressure frequency characteristic that multiple peaks and dips occur (see FIG. 38) is observed. This is because the diaphragm 111 is formed of a thin film as an elongated shape, and therefore multiple resonances occur from a low frequency in the long side direction of the diaphragm 111.

However, in the speaker 100 of the present invention, a drive force is applied to the diaphragm 111 entirely along the long side direction, thereby enabling resonance of the diaphragm 111 to be suppressed in the long side direction. A relationship between the resonance suppression effect and the length of the driven portion of the diaphragm 111 in the long side direction, which is obtained for the speaker 100, will be described below by using a finite element analysis.

Figure 6:
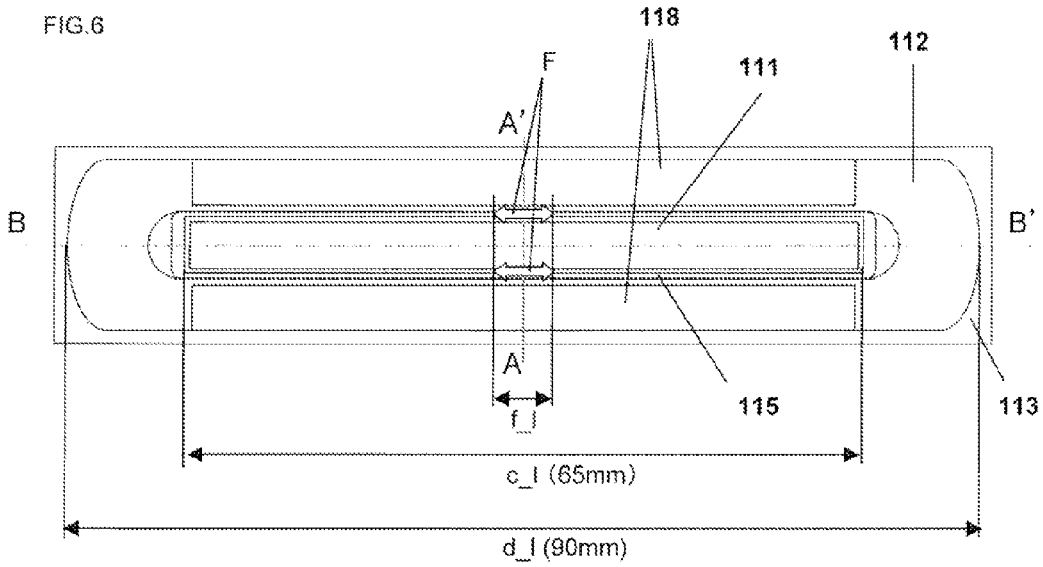
FIG. 6 is a plan view of the speaker 100 to be subjected to a finite element analysis, illustrating a resonance of a diaphragm 111 in the long side direction.

FIG. 6 is a plan view of the speaker 100 to be subjected to the finite element analysis, illustrating the resonance of the diaphragm 111 in the long side direction. In the finite element analysis, the drive force F which is generated by a drive current being applied to the voice coil 115 is applied to a predetermined portion (a portion indicated by f_l) of the voice coil 115. Outline arrows shown in FIG. 6 indicate portions to which the drive force F is applied. The length of the portion indicated by f_l to which the drive force F is applied is gradually increased from "0", to measure change in the sound pressure frequency characteristic. Specifically, the length of f_l is increased from the length "0" to the length "c_l", and the length "0" represents a case where the drive force F is applied to only the center line A-A' of the vibration system 150, and the length "c_l" represents a case where the drive force F is applied to the entire length of the voice coil 115. In the analysis described above, the vibration system 150 is formed as a polyimide resin film having the thickness of 0.075 mm, and the entire length d_l of the vibration system 150 is 90 mm, and the entire length c_l of the voice coil 115 is 65 mm. In this case, the rate of the voice coil 115 to the vibration system 150 in length is about 72%.

Figure 7:
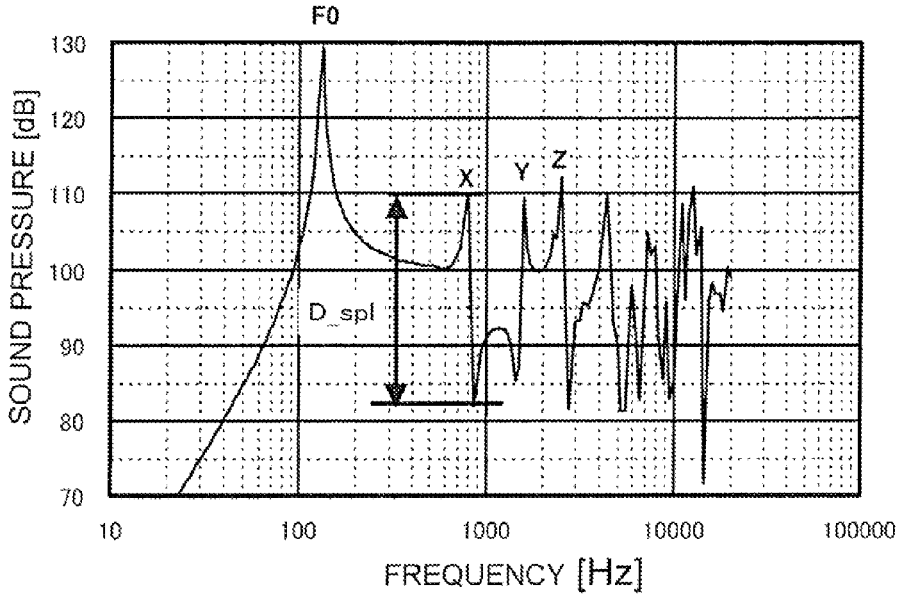
FIG. 7 is a diagram illustrating a result of an analysis of a sound pressure frequency characteristic of the speaker 100, which is obtained when a drive force F is applied to only the center line A-A' (when f_l=0 is satisfied).

FIG. 7 is a diagram illustrating a result of an analysis of the sound pressure frequency characteristic of the speaker 100, which is obtained when the drive force F is applied to only the center line A-A' (when f_l=0 is satisfied). As shown in FIG. 7, the earliest great peak dip occurs at about 800 Hz as indicated by X, the immediately following great peak dip occurs at about a frequency indicated by Y, and a great peak dip, which immediately follows the peak dip occurring at about the frequency indicated by Y, occurs at about a frequency indicated by Z. Results of investigating vibration modes at about frequencies indicated by X, Y, and Z indicate that the peak dips occur at about frequencies indicated by X and Y by the resonance mode associated with the long side direction of the vibration system 150, and the peak dip occurs at about frequency indicated by Z by the resonance mode associated with the short side direction of the vibration system 150. The lowest resonance frequency $F_0$ appears at about 140 Hz.

Figure 8:
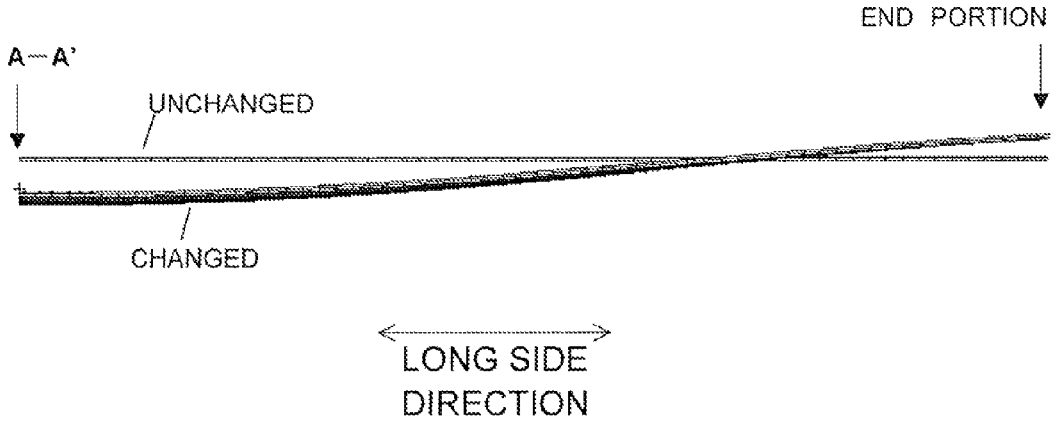
FIG. 8 is a diagram illustrating a vibration mode of a voice coil 115, which is associated with the long side direction thereof and is observed at a peak occurring at about a frequency indicated by X.

FIG. 8 is a diagram illustrating a vibration mode of the voice coil 115, which is associated with the long side direction thereof and is observed at a peak occurring at about the frequency indicated by X. Since the vibration mode of the voice coil 115 at the peak occurring at about the frequency indicated by X represents a shape which is bilaterally symmetric about the center line A-A' shown in FIG. 6, FIG. 8 shows only a right half shape of the mode. In FIG. 8, the left end of the mode shape corresponds to the positions of the center line A-A' while the right end of the mode shape corresponds to the end of the voice coil 115 in the long side direction. The resonance mode shown in FIG. 8 is a resonance mode in which amplitudes of the center portion and the end portion of the diaphragm 111 are maximum, and therefore the resonance mode shown in FIG. 8 is a first-order resonance mode in the long side direction.

Figure 9:
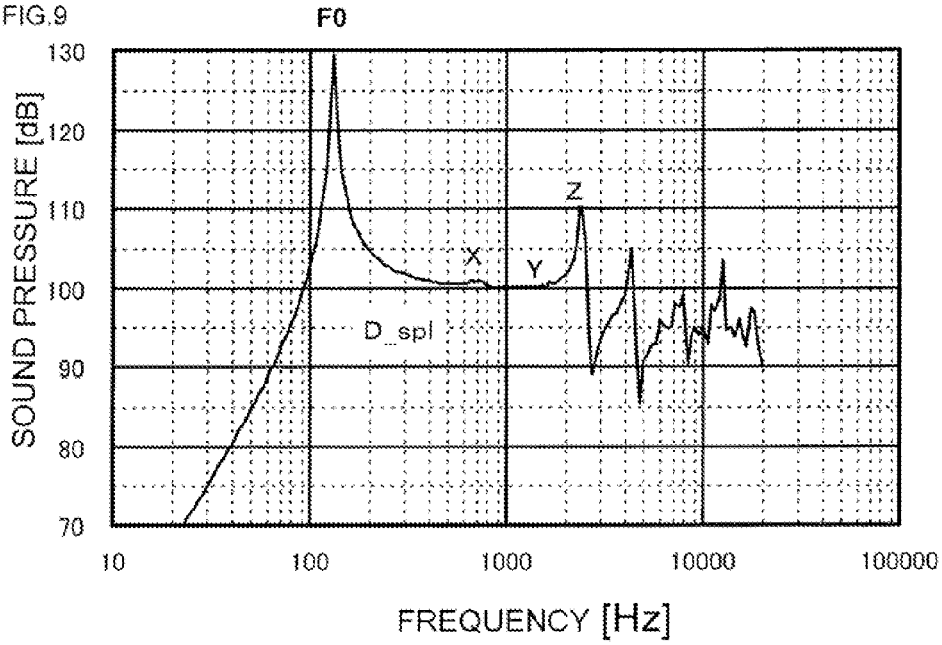
FIG. 9 is a diagram illustrating a result of an analysis of a sound pressure frequency characteristic of the speaker 100, which is obtained when a drive force F is applied to the entire voice coil 115 (when f_l=c_l is satisfied).
Figure 10:
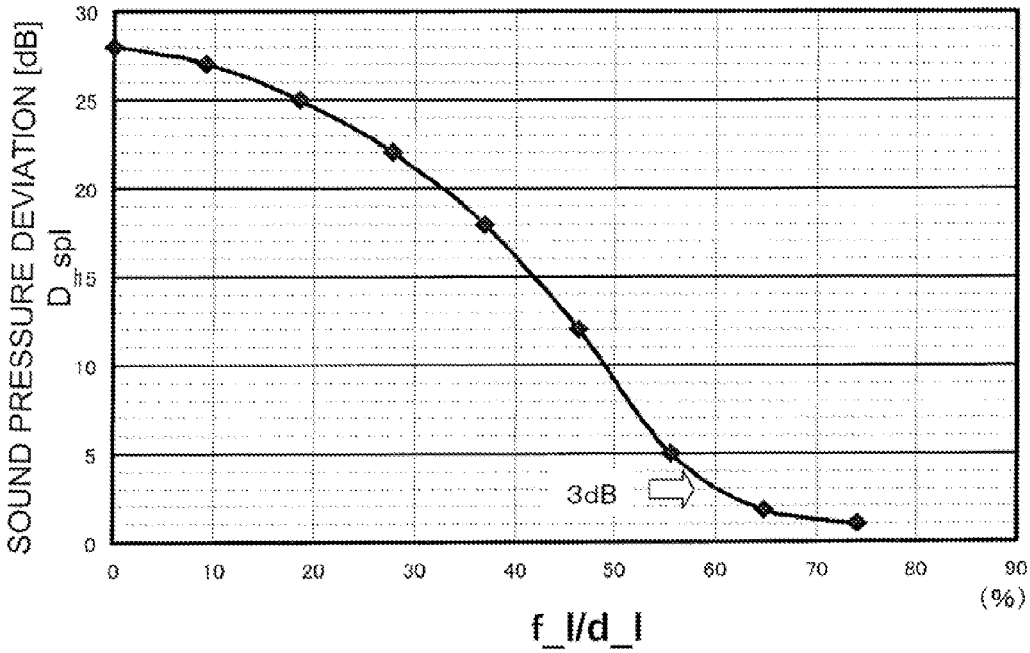
FIG. 10 is a diagram illustrating a relationship between a peak dip (sound pressure deviation) and a rate ((f_l/d_l), in length, of a driven portion of a diaphragm to the vibration system 150 in the long side direction, the relationship being obtained by using the finite element analysis.

When the length of the portion of f_l to which the drive force F is applied is gradually increased from 0, the resonance of the diaphragm 111 in the long side direction is suppressed, resulting in the peak dips being attenuated at about the frequencies indicated by X and Y. FIG. 9 is a diagram illustrating a result of an analysis of the sound pressure frequency characteristic of the speaker 100, which is obtained when the drive force F is applied to the entire voice coil 115 (when f_l=c_l is satisfied). As shown in FIG. 9, when the drive force F is applied to the entire voice coil 115, the peak dips which occur at about the frequencies indicated by X and Y by the resonance mode of the vibration system 150 in the long side direction are substantially eliminated. Thus, a sound reproduction bandwidth which can be used for enabling the speaker 100 to output a high quality sound is broadened approximately to the bandwidth of the frequency indicated by Z as shown in FIG. 9. That is, the resonance mode associated with the long side direction is suppressed by increasing the length of the driven portion of the diaphragm 111 in the long side direction. FIG. 10 is a diagram illustrating a relationship between the peak dip (sound pressure deviation) and the rate (f_l/d_l), in length, of the driven portion of the diaphragm to the vibration system 150 in the long side direction, and the relationship is obtained by using the finite element analysis described above. FIG. 10 shows that, when at least 60% of the entire vibration system 150 is driven in the long side direction, the sound pressure deviation is less than or equal to 3 dB, which is generally regarded as a preferable sound pressure deviation.

The resonance suppression effect for the long side direction of the diaphragm 111 has been described above. The resonance suppression effect for the short side direction of the diaphragm 111 will be described below.

As described above, in the speaker 100, the diaphragm 111 is driven entirely along the long side direction while the end portion of the diaphragm 111 is driven in the short side direction. Therefore, it is difficult to completely suppress the resonance occurring in the diaphragm 111 in the short side direction. As a result, as shown in FIG. 9, the first-order resonance mode (see Z) occurs in the diaphragm 111 in the short side direction.

However, in the diaphragm 111, the resonance frequency for the short side direction is enhanced due to an effect of the projecting structure of the box-shaped five face body 101, as compared to a planar shape. The diaphragm 111 (the box-shaped five face body 101) is formed of a thin film material such as a polyimide resin, and typically has the thickness ranging from 50 μm to several hundred μm as described above. Further, the height (thickness) of the projecting portion of the box-shaped five face body 101 is preferably at least twice as great as the height (thickness) of the voice coil 115. When the speaker 100 is caused to make an output equivalent to an output from a round speaker having the diameter of 8 cm, the height of the projecting portion of the box-shaped five face body 101 is about 5 mm. When the thickness of the box-shaped five face body 101 is 50 μm, and the height of the projecting portion of the box-shaped five face body 101 is 5 mm, 5 mm is 100 times as great as 50 μm if simply compared. Although the 100 times difference is not directly reflected in the resonance suppression effect for the short side direction, the rigidity of the diaphragm 111 in the short side direction is substantially enhanced due to the projecting structure described above. As a result, the resonance is suppressed for the diaphragm 111 in the short side direction, and the resonance frequency of the first-order resonance mode is enhanced.

As described above, in the speaker 100 according to the first embodiment, the resonance is suppressed in the long side direction by a drive force being applied to a portion of at least 60% of the entire length of the vibration system 150 along the long side direction thereof whereas the resonance frequency for the short side direction can be enhanced due to the diaphragm 111 being configured to have an enhanced rigidity. Thus, in the speaker 100, the flat sound pressure frequency characteristic can be obtained up to an enhanced frequency, and the diaphragm 111 can be caused to perform piston movement so as to suppress the influence of the resonance up to an enhanced frequency. As a result, in the speaker 100 of the first embodiment, the sound quality can be substantially improved as compared to in the conventional slim-type speaker 900 (see FIG. 37).

As described above, the dimensions of the diaphragm 111 are determined such that, when the length of the diaphragm 111 in the long side direction is 1, the length thereof in the short side direction is preferably less than or equal to 0.5. If the diaphragm 111 has a planar shape, the first-order resonance frequency in the short side direction is inversely proportional to the square of the first-order resonance frequency in the long side direction, in the diaphragm 111. For example, when the diaphragm 111 has such dimensions that the aspect ratio thereof is 2:1, the first-order resonance frequency of the diaphragm 111 in the long side direction is fL1[Hz], and the first-order resonance frequency of the diaphragm 111 in the short side direction is fS1[Hz], the value of fS1 is calculated as 4*fL1. When the diaphragm 111 is formed as a box-shaped five face body, the length in the short side direction is increased due to the projection, thereby lowering the resonance frequency. However, according to the first embodiment, the more elongated shape the diaphragm 111 has, the greater the resonance suppression effect of the speaker 100 is.

Realization of the speaker 100 of the first embodiment having the reduced thickness will be described below. As shown in FIG. 4, in the speaker 100 of the first embodiment, the voice coil 115 is disposed at the almost center position between the top of the projecting portion of the box-shaped five face body 101 and the top of the roll-shaped projection of the edge 112. That is, the voice coil 115 is disposed at almost the vertically center position of the vibration system 150. Further, the inner magnetic pole including the lower plate 120 and the lower magnet 117 is disposed in the recessed portion of the diaphragm 111. Moreover, the two outer magnetic poles each including the upper plate 119 and the upper magnet 116 are disposed lateral to both the sides of the diaphragm 111 so as to extend in the direction of the recessed portion of the roll shape of the edge 112. The voice coil 115 is disposed between the inner magnetic pole and the outer magnetic poles. Such a disposition allows the inner magnetic pole and the outer magnetic poles to be disposed in the recessed portions of the vibration system 150 having the diaphragm 111 and the edge 112. Further, in such a disposition, a clearance between the inner magnetic pole and the diaphragm 111 may be considered when a position of the inner magnetic pole is determined whereas a clearance between the outer magnetic poles and the edge 112 may be considered when positions of the outer magnetic poles are determined. More specifically, only a distance over which the diaphragm 111 moves downward while vibrating may be considered when a position of the inner magnetic pole is determined. This is because any component which is likely to contact the diaphragm 111 is not basically provided in the direction in which the diaphragm 111 moves upward while vibrating, and therefore it is unnecessary to consider a clearance above the diaphragm 111. On the other hand, only a distance over which the edge 112 moves upward while vibrating may be considered when positions of the outer magnetic poles are determined. This is because any component which is likely to contact the edge 112 is not basically provided in the direction in which the edge 112 moves downward while vibrating, and therefore it is unnecessary to consider a clearance below the edge 112. As described above, in the speaker 100 of the first embodiment, the inner magnetic pole and the outer magnetic poles are disposed so as to be inserted into the recessed portions of the vibration system 150, so that the thickness can be substantially reduced as compared to in a conventional speaker (see FIG. 37).

As described above, in the speaker 100 of the first embodiment, a sound quality can be substantially improved as well as the thin shape can be realized as compared to in the conventional slim-type speaker 900 (see FIG. 37).

Figure 11:
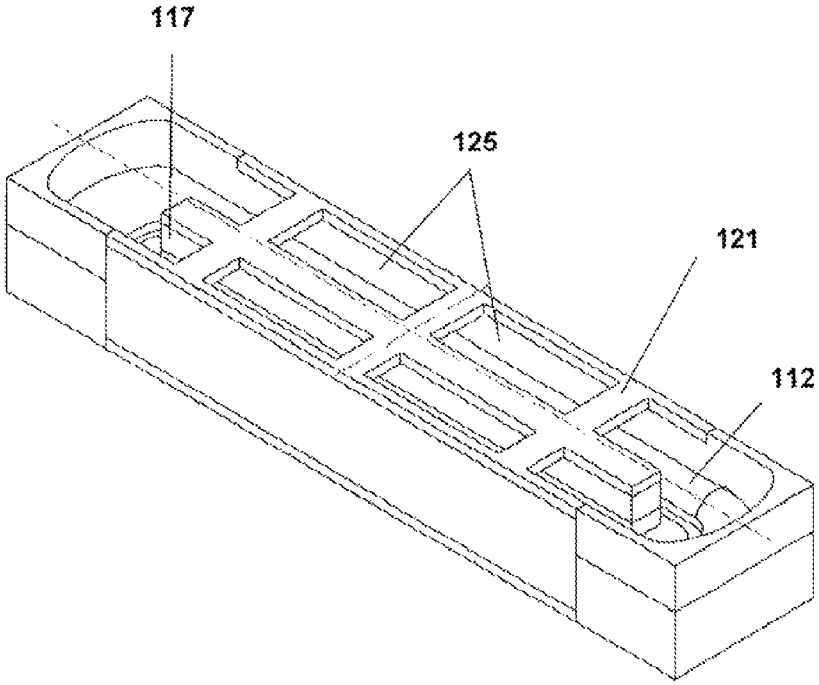
FIG. 11 is a perspective view of another example of the speaker 100 according to the first embodiment.

In the above description, an opening is provided near the upper yoke 118 to emit a sound and voice from near the upper yoke 118 (see FIG. 1 and FIG. 4). However, as shown in FIG. 11, no opening is provided near the upper yoke 118 and an opening 125 may be provided near the lower yoke 121 to emit a sound and voice from near the lower yoke 121. Thus, a sound and voice generated in the reverse side of the vibration system 150 may be emitted.

Figure 12:
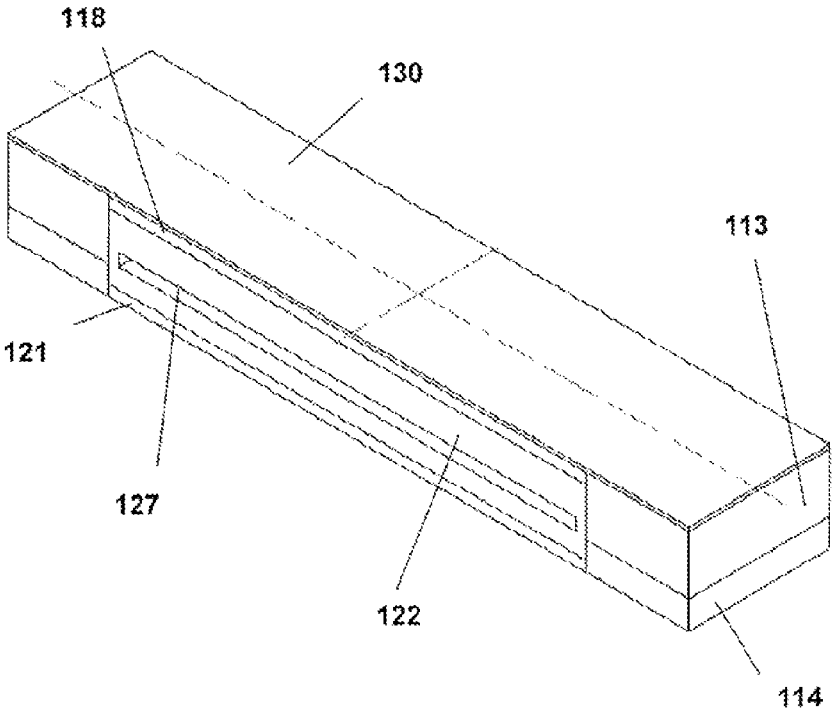
FIG. 12 is a perspective view of still another example of the speaker 100 according to the first embodiment.

Moreover, as shown in FIG. 12, no opening is provided near the upper yoke 118, and an opening 127 may be provided near the side yoke 122 to emit a sound and voice from near the side yoke 122. In this case, the opening near the upper yoke 118 is enclosed by, for example, a top frame 130. Thus, a sound and voice can be emitted from the side face of the speaker 100, thereby enabling the speaker 100 to be mounted in a reduced space.

Second Embodiment

A speaker 200 according to a second embodiment has a distinguished feature, in addition to the features of the speaker 100 according to the first embodiment, that a reinforcing rib for enhancing rigidity of a diaphragm in the short side direction is provided on a diaphragm. For the speaker 200 of the second embodiment, the same components as described for the speaker 100 of the first embodiment are denoted by the same corresponding reference numerals, and the description thereof is not basically given.

Figure 13:
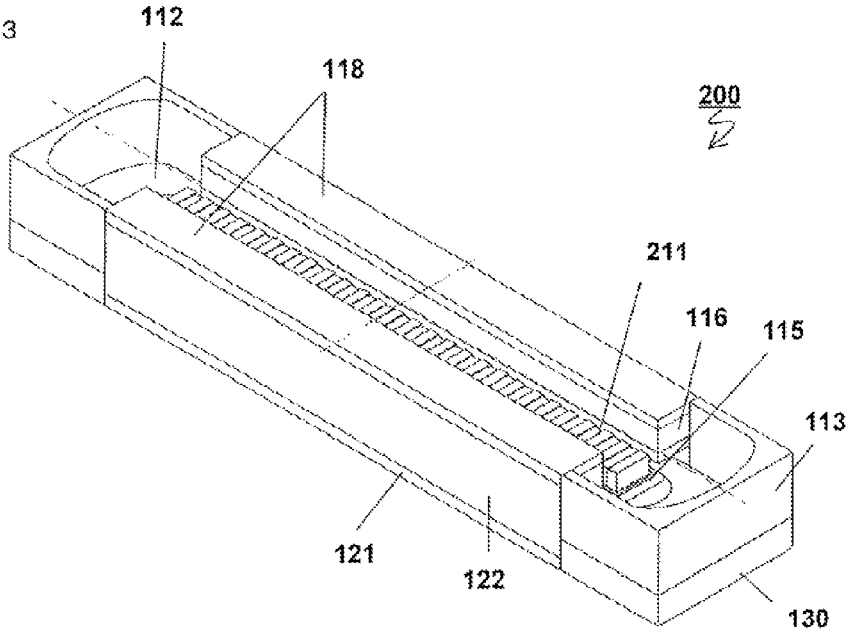
FIG. 13 is a perspective view of an example of a speaker 200 according to a second embodiment.
Figure 14:
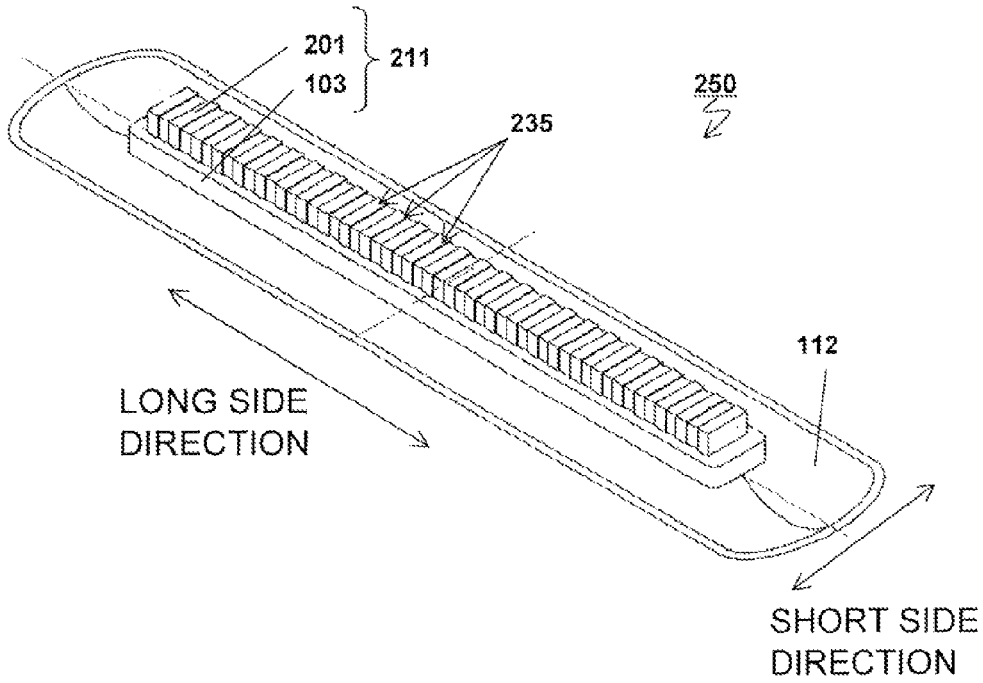
FIG. 14 is a diagram illustrating a vibration system 250 of the speaker 200 according to the second embodiment.
Figure 15:
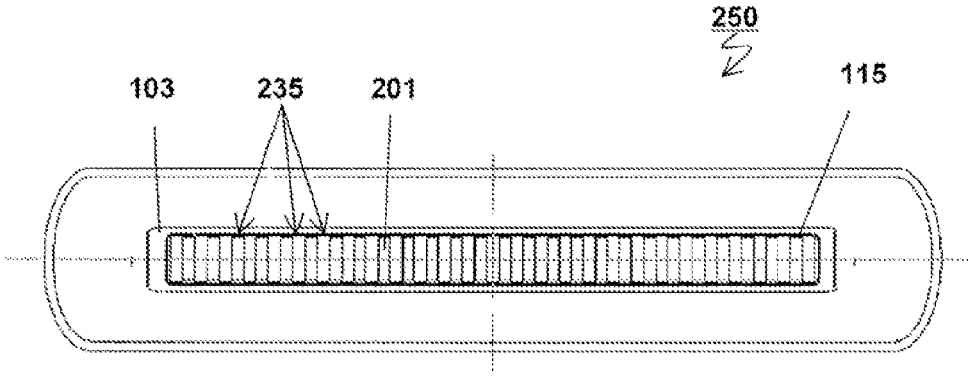
FIG. 15 is a diagram illustrating the vibration system 250 of the speaker 200 according to the second embodiment.
Figure 16:
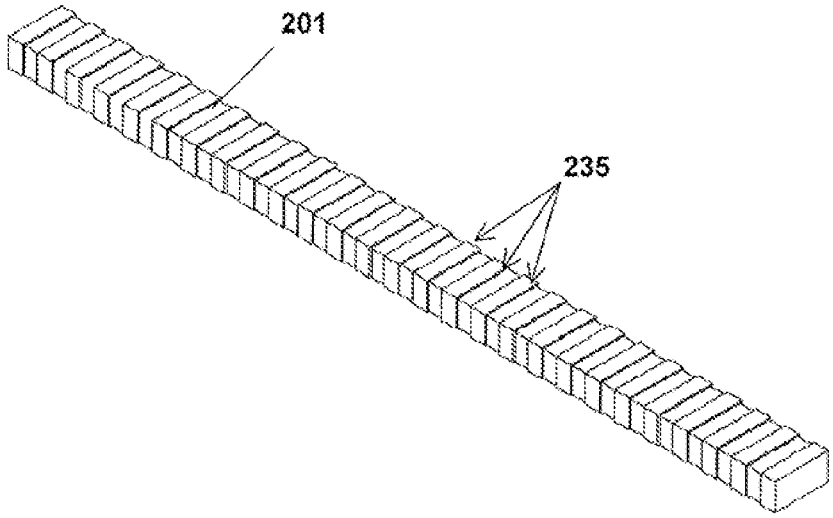
FIG. 16 is a perspective view of a box-shaped five face body 201 forming the vibration system 250.

FIG. 13 is a perspective view of an example of the speaker 200 according to the second embodiment. FIG. 14 and FIG. 15 are diagrams illustrating a vibration system 250 of the speaker 200 according to the second embodiment. FIG. 16 is a perspective view of a box-shaped five face body 201 of the vibration system 250.

As shown in FIG. 13 to FIG. 15, the speaker 200 of the second embodiment has the same configuration as the speaker 100 (see FIG. 1 and FIG. 2) of the first embodiment except that the vibration system 250 is used for the speaker 200 instead of the vibration system 150. The vibration system 250 has the same configuration as the vibration system 150 except that a diaphragm 211 is used for the vibration system 250 instead of the diaphragm 111. The diaphragm 211 has the same configuration as the diaphragm 111 except that a box-shaped five face body 201 is used for the diaphragm 211 instead of the box-shaped five face body 101.

As shown in FIG. 16, the box-shaped five face body 201 is configured to include a plurality of reinforcing ribs 235, and the plurality of reinforcing ribs 235 are formed by projections and recesses being disposed on three faces of the box-shaped five face body 101 (see FIG. 3) which are parallel to the long side direction thereof, to enhance rigidity in the short side direction. The reinforcing ribs 235 are preferably provided on the three faces parallel to the long side direction in the box-shaped five face body 201 so as to form a continuous recessed and projecting shape, as shown in FIG. 16. Further, the reinforcing ribs 235 are preferably integrated simultaneously when the vibration system 250 is integrally formed.

An effect exerted by the speaker 200 of the second embodiment will be described below. The speaker 200 of the second embodiment exerts not only the effect exerted by the speaker 100 of the first embodiment, but also the effect that enhancement of the resonance frequency is increased by the reinforcing ribs 235 allowing increased enhancement of the rigidity of the diaphragm 211 in the short side direction. The effect exerted by the reinforcing ribs 235 will be specifically described below by using the finite element analysis.

Figure 17:
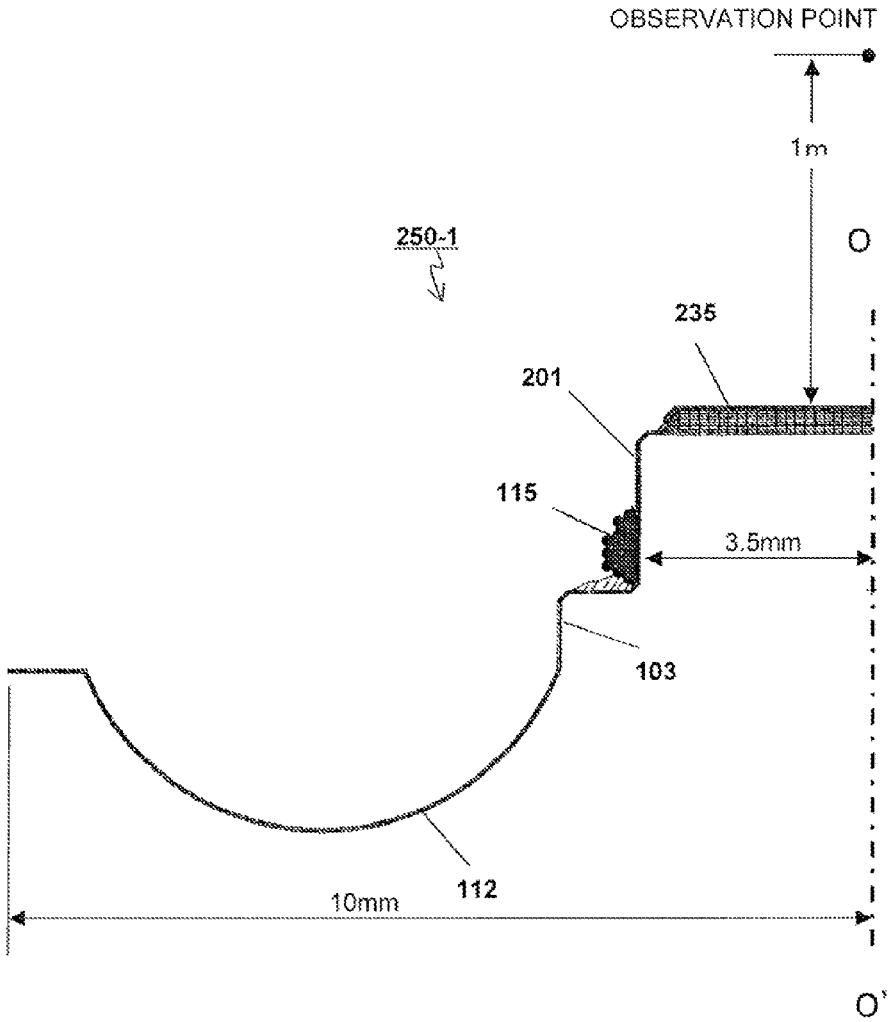
FIG. 17 is a diagram illustrating a model 250-1 representing a cross-sectional shape of the vibration system 250 in the short side direction, and also showing reinforcing ribs 235 are provided only on the upper face of the box-shaped five face body 201.

FIG. 17 is a diagram illustrating a model 250-1 representing a cross-sectional shape of the vibration system 250 in the short side direction, and also showing that the reinforcing ribs 235 are formed only on the upper face of the box-shaped five face body 201. In FIG. 17, the model 250-1 is a model representing a left half portion of the cross-sectional shape of the vibration system 250 which is bilaterally symmetric with respect to the center line o-o'. As shown in FIG. 17, the reinforcing ribs 235 are formed only on the upper face of the box-shaped five face body 201. The voice coil 115 is fixed to the box-shaped five face body 201 and the inverse-L-shaped flange 103 near a joining point therebetween. The inner periphery portion of the edge 112 is joined to the end portion of the inverse-L-shaped flange 103, and the outer periphery portion of the edge 112 is fixed by the upper frames 113 or the like (not shown). In the model 250-1, the thickness is 50 μm, the width (the width from the center line o-o' to the outer periphery of the edge 112) of the left half portion of the vibration system 250 is 10 mm, the width of the left half portion of the box-shaped five face body 201 is 3.5 mm, and the material is a polyimide resin. In accordance with the finite element analysis, a drive force is applied to the voice coil 115 of the model 250-1, the deformation of the model 250-1 is analyzed, and the sound pressure frequency characteristic is calculated at an observation point which is on the center line o-o' and is distant from the upper face of the box-shaped five face body 201 by 1 m.

Figure 18:
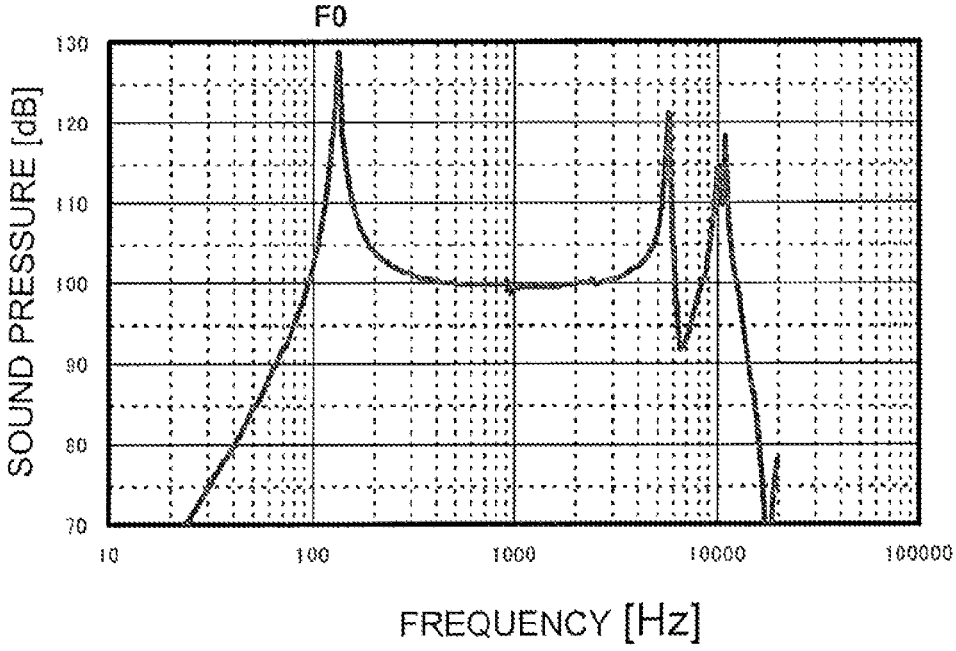
FIG. 18 is a diagram illustrating a result of a finite element analysis of the model 250-1.

FIG. 18 is a diagram illustrating the result of the finite element analysis of the model 250-1 described above. In FIG. 18, the horizontal axis represents reproduction frequencies for a sound and voice, and the vertical axis represents reproduced-sound pressure levels of the sound and voice. As shown in FIG. 18, peaks of reproduced-sound pressure which are caused by the resonance occur at frequency 5.5 kHz and frequency 10.05 kHz, and the characteristic is unstable. $F_0$ represents a lowest resonance frequency. In general, a speaker is required to have a characteristic that the reproduced-sound pressure is constant even when the reproduction frequency varies. Therefore, in the model 250-1, a usable bandwidth in which a sound and voice can be reproduced with enhanced quality is up to 5.5 kHz. Therefore, peaks of reproduced-sound pressure which occur at 5.5 kHz and 10.05 kHz need to occur at a higher frequency in order to enlarge the usable bandwidth in which a sound and voice can be reproduced with enhanced quality.

As described in the first embodiment, in the speaker 200, the diaphragm 211 is driven entirely along the long side direction of the vibration system 250, and therefore the resonance is suppressed in the long side direction. Therefore, the limit of the usable bandwidth (hereinafter, simply referred to as a usable bandwidth) in which a sound and voice can be reproduced with enhanced quality is defined based on the resonance frequency for the short side direction of the vibration system 250. Therefore, two models 250-2 and 250-3, each of which has the vibration system 250 having the same width as that of the model 250-1 in the short side direction as a whole, and has the box-shaped five face body 201 having the width different from that of the model 250-1, are prepared. The usable bandwidth is compared among the three models including the model 250-1.

Figure 19:
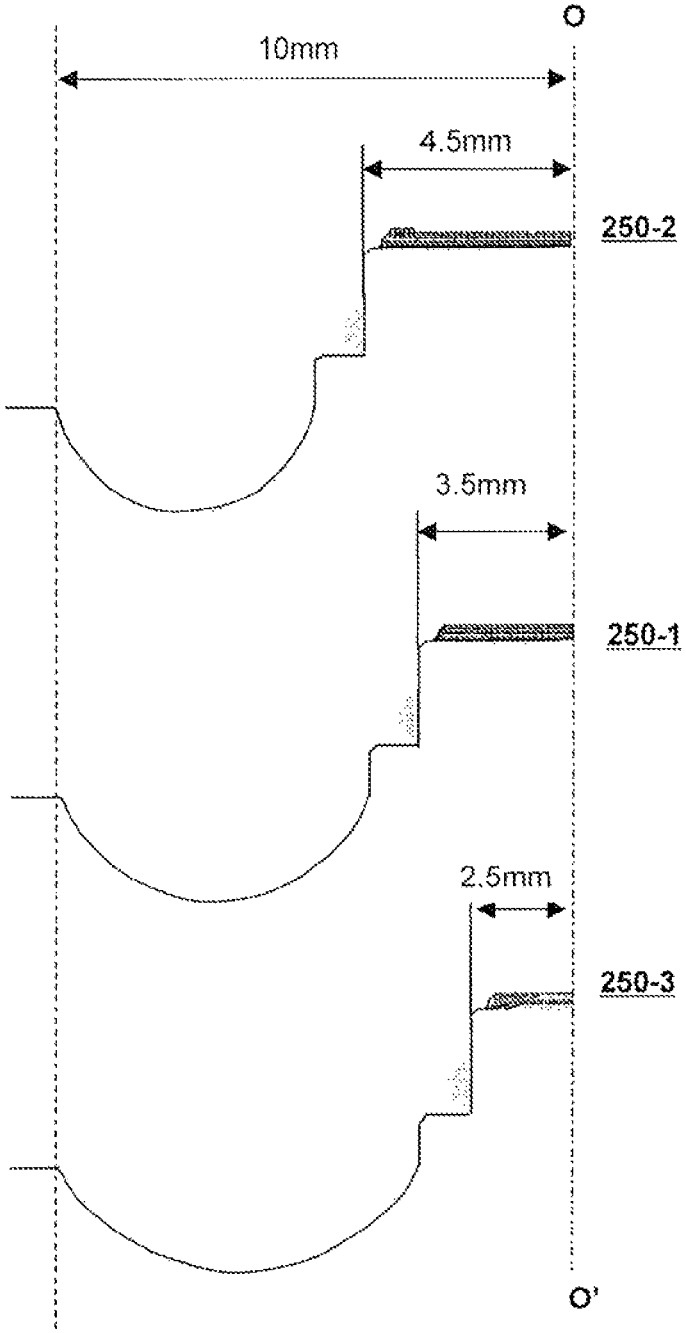
FIG. 19 is a diagram illustrating models 250-2, 250-1, and 250-3.

FIG. 19 is a diaphragm illustrating the models 250-2, 250-1, and 250-3. As shown in FIG. 19, half the width of the box-shaped five face body 201 of the model 250-2 is 4.5 mm, half the width of the box-shaped five face body 201 of the model 250-1 is 3.5 mm, and half the width of the box-shaped five face body 201 of the model 250-3 is 2.5 mm. In FIG. 19, as in FIG. 17, models each representing the left half portion of the vibration system 250 are shown. Further, the model 250-1 shown in FIG. 19 is the same as the model 250-1 shown in FIG. 17.

Figure 20:
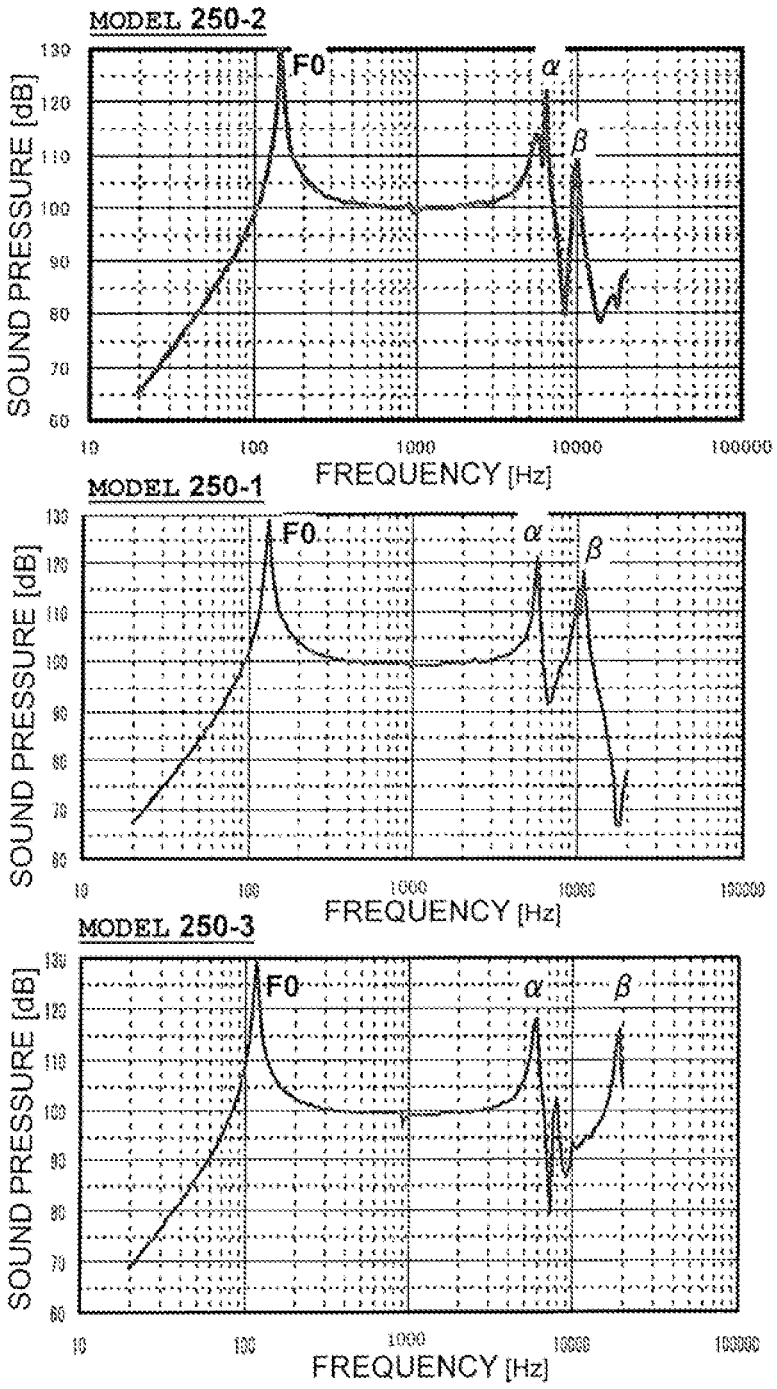
FIG. 20 is a diagram illustrating results of finite element analyses of the models 250-2, 250-1, and 250-3 shown in FIG. 19.

FIG. 20 is a diagram illustrating results of the finite element analyses of the models 250-2, 250-1, and 250-3 shown in FIG. 19. The analysis result for the model 250-1 shown in FIG. 20 is the same as the analysis result for the model 250-1 shown in FIG. 18. Further, $F_0$ represents a lowest resonance frequency. As shown in FIG. 20, the comparison in the sound pressure frequency characteristic among the three models indicates that a frequency at which the second peak β of the reproduced-sound pressure occurs is 9.9 kHz in the model 250-2, is 10.5 kHz in the model 250-1, and is 10.9 kHz in the model 250-3. Thus, it can be understood that the smaller the width of the box-shaped five face body 201, the higher the frequency at which the peak β occurs. On the other hand, as shown in FIG. 20, a frequency at which the first peak α of the reproduced-sound pressure occurs is about 5.5 KHz in each of the three models. Thus, it can be understood that the usable bandwidth is not enlarged by the width of the box-shaped five face body 201 being simply changed as in the models shown in FIG. 19.

Figure 21:
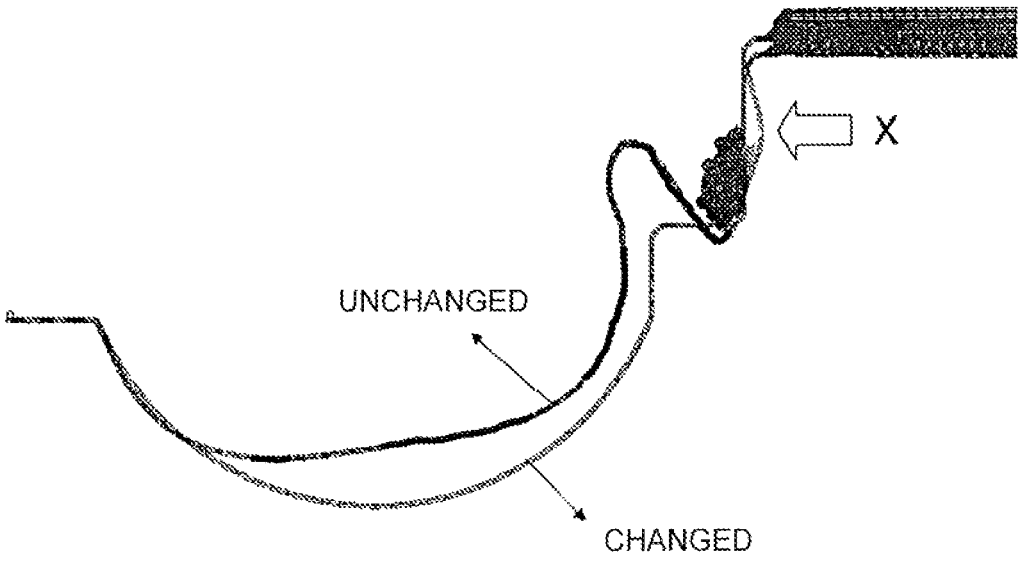
FIG. 21 is a diagram showing that, in the model 250-1 shown in FIG. 17, a shape (deformed shape) of a resonance mode at 5.5 kHz is put on an undeformed shape.

FIG. 21 is a diagram showing that, in the model 250-1 shown in FIG. 17, a shape (deformed shape) of the resonance mode at 5.5 kHz is put on an undeformed shape. As shown in FIG. 21, it is understood that the resonance occurring at 5.5 kHz is caused by deformation occurring at the side face portion (a portion represented by X in FIG. 21) of the box-shaped five face body 201, to which the voice coil 115 is fixed.

Figure 22:
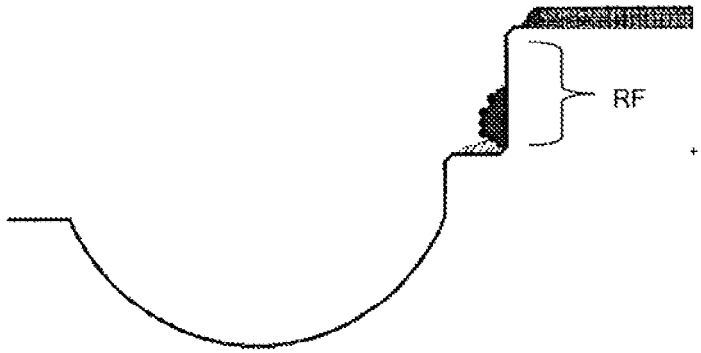
FIG. 22 is a diagram illustrating a result of an analysis performed in the case of the Young's modulus of the side face portion of the box-shaped five face body 201 being increased tenfold in the model 250-1 shown in FIG. 17.
Figure 22:
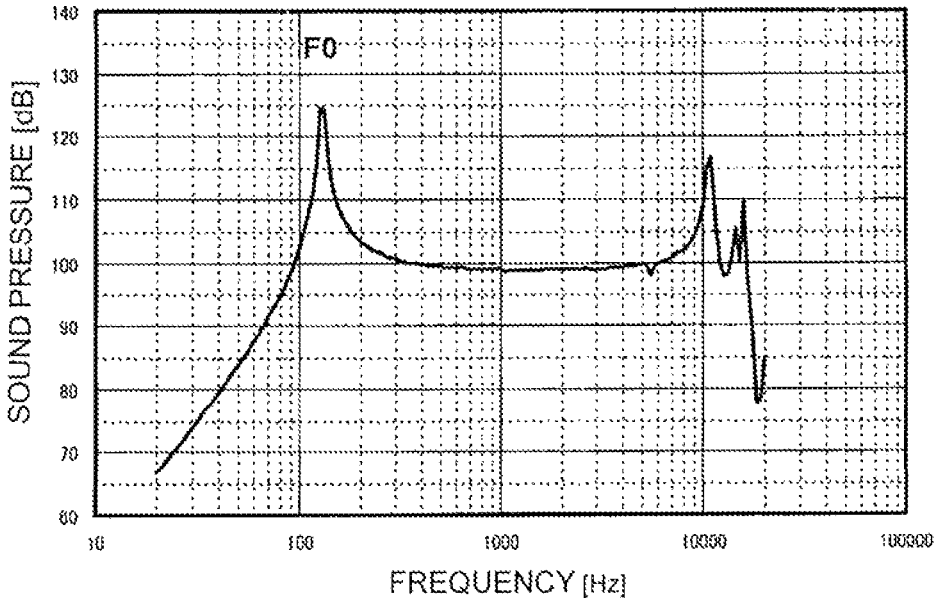

In order to enlarge the usable bandwidth, the Young's modulus of the side face portion of the box-shaped five face body 201 is increased tenfold, and the analysis is performed again. FIG. 22 is a diagram illustrating a result of the analysis performed in the case of the Young's modulus of the side face portion of the box-shaped five face body 201 being increased tenfold in the model 250-1 shown in FIG. 17. FIG. 22(*a*) is a diagram illustrating the model 250-1 in which the Young's modulus of the side face portion of the box-shaped five face body 201 is increased tenfold. In FIG. 22(*a*), the side face portion of the box-shaped five face body 201 as indicated by RF has the Young' modulus which is increased tenfold. The other conditions are the same as described for the model 250-1 shown in FIG. 17. FIG. 22(*b*) is a diagram illustrating a result of the finite element analysis for the model 250-1 shown in FIG. 22(*a*). As shown in FIG. 22(*b*), the peak α of the reproduced-sound pressure occurring at 5.5 kHz is eliminated, and the usable bandwidth is enlarged up to 10.05 kHz. The result of the analysis indicates that, when the rigidity of the side face portion of the box-shaped five face body 201 is enhanced in the short side direction, the usable bandwidth can be enlarged.

Figure 23:
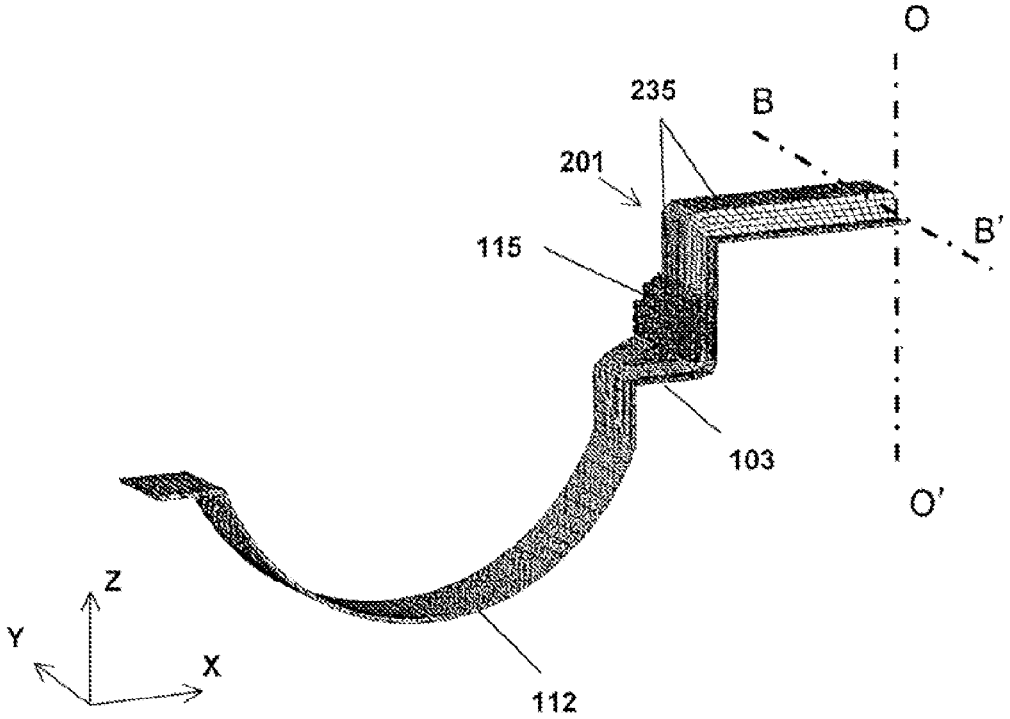
FIG. 23 shows that the model 250-1 shown in FIG. 17, which is represented as a three-dimensional model, has reinforcing ribs 235 formed, as a continuous projecting and recessed shape, on the side face and the upper face of the box-shaped five face body 201.
Figure 24:
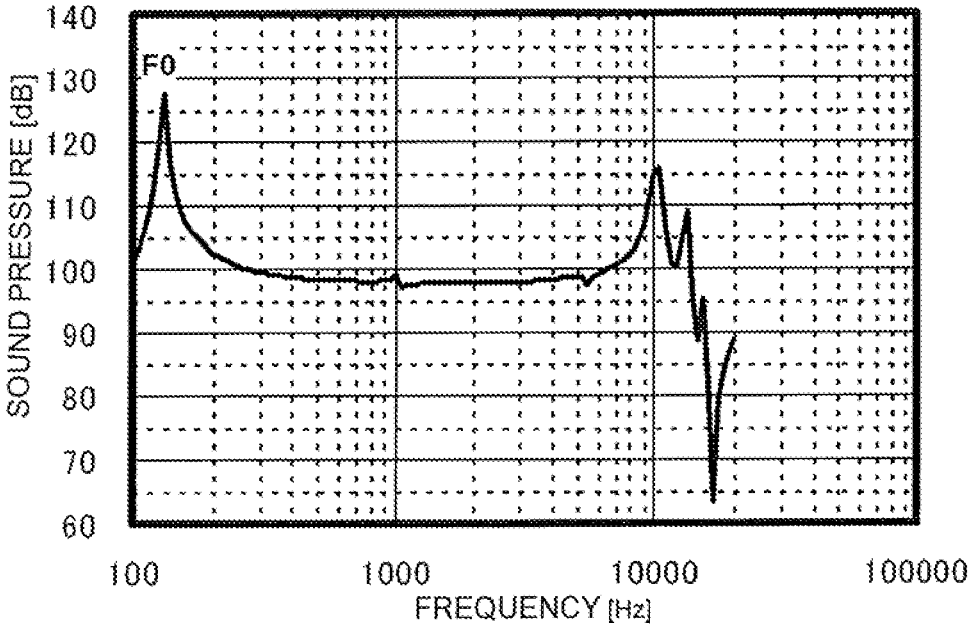
FIG. 24 is a diagram illustrating a result of the finite element analysis of the model having the reinforcing rib 235 shown in FIG. 23.

In order to enhance the rigidity of the side face portion of the box-shaped five face body 201 in the short side direction, reinforcing ribs forming a plurality of projections and recesses are disposed on the side face portion of the box-shaped five face body 201 in addition to the upper face portion of the box-shaped five face body 201. As described below, the effect of the reinforcing ribs is verified by using the finite element analysis. FIG. 23 shows that the model 250-1 shown in FIG. 17, which is represented as a three-dimensional model, has the reinforcing ribs 235 formed, as a continuous projecting and recessed shape, on the side face and the upper face of the box-shaped five face body 201. For the convenience of the calculation, in the model shown in FIG. 23, the width of the vibration system 250 in the long side direction (B-B' direction) corresponds to the width of a single reinforcing rib among the reinforcing ribs 235. FIG. 24 is a diagram illustrating the result of the finite element analysis of the model having the reinforcing rib 235 shown in FIG. 23. As shown in FIG. 24, the peak α of the reproduced-sound pressure occurring at 5.5 kHz is eliminated, and the usable bandwidth is enlarged up to 10.05 kHz. In the above description, the reinforcing ribs 235 are formed only on the box-shaped five face body 201. However, the reinforcing ribs 235 may be integrally formed so as to extend from the box-shaped five face body 201 up to the edge of the inverse-L-shaped flange 103.

According to the result of the finite element analysis as described above, in the speaker 200 according to the second embodiment, when the box-shaped five face body 201 forming the vibration system 250 has a plurality of the reinforcing ribs 235, improvement of the sound quality can be increased in addition to the effect of the speaker 100 (see FIG. 1) of the first embodiment being exerted.

Third Embodiment

In each of the speaker 100 of the first embodiment and the speaker 200 of the second embodiment, the diaphragm and the edge which form the vibration system are made of the same material and integrated into one component. A speaker 300 (not shown) according to the third embodiment has a distinguished feature that a diaphragm and an edge which form the vibration system are formed as different components, respectively, and the different components are coupled to each other. Difference from the speaker 200 according to the second embodiment will be mainly described below as an example. The components which are the same between the speaker 200 of the second embodiment and the speaker 300 of the third embodiment are denoted by the same corresponding reference numerals, and the description thereof is not basically given.

Figure 25:
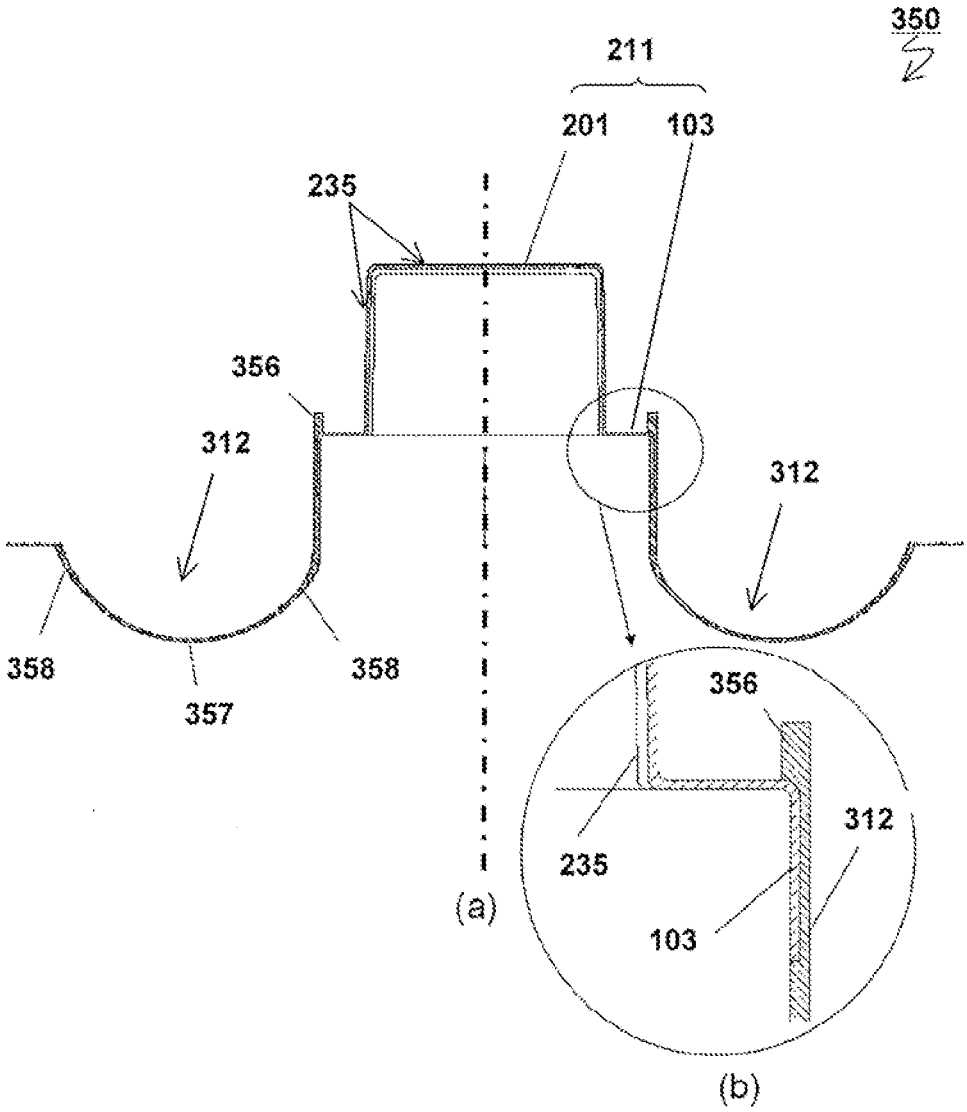
FIG. 25 is a diagram illustrating a vibration system 350 of a speaker 300 according to a third embodiment.

FIG. 25 is a diagram illustrating a vibration system 350 of the speaker 300 according to the third embodiment. As shown in FIG. 25, an edge 312 is fixed to the lower end portion of the inverse-L-shaped flange 103. The diaphragm 211 may be formed through vacuum forming or the like, for example, by using, as material, a polymer film formed of a polyimide resin or the like. Alternatively, the diaphragm 211 may be formed by using pulp or the like as material. The edge 312 is made of a material different from that of the diaphragm 211. In order to form the edge 312, for example, a rubber may be foamed and formed in a die as a foamed rubber which is a viscoelastic component. Alternatively, for example, the edge 312 may be formed through injection molding by using a high-molecular weight elastomer material which is a polymer of a rubber and a high molecular weight component.

Further, the edge 312 is a roll edge having an almost semicircular (arc-shaped) cross section as shown in FIG. 25, and, in a roll shape thereof, the thickness of a deepest portion 357 is less than the thickness of a base portion 358. In the roll shape thereof, the thickness of the base portion 358 is preferably at least 1.5 times as great as the thickness of the deepest portion 357.

Further, as shown in an enlarged view (b) of FIG. 25, the inner periphery portion of the edge 312 is joined to and along the outer periphery portion of the inverse-L-shaped flange 103. The edge 312 and the inverse-L-shaped flange 103 may be joined to each other by using an adhesive, or may be fused with each other through insert molding. In addition, a projection 356 is preferably formed when the edge 312 and the inverse-L-shaped flange 103 are joined to each other.

An operation and effect of the speaker 300 according to the third embodiment will be described below. In the speaker 300, the diaphragm 211 and the edge 312 which form the vibration system 350 are made of different materials, respectively. Therefore, materials of the diaphragm 211 and the edge 312 may be selected in accordance with a required characteristic for the speaker 300. As a result, improvement of the performance of the speaker 300 can be increased. This will be specifically described below.

As described above, for example, the diaphragm 211 is formed of a polymer film made of a polyimide resin or the like, or formed of pulp, and the polymer film and the pulp each have light weight and high rigidity. Thus, the diaphragm 211 can vibrate up to an enhanced frequency and with reduced deformation, thereby elevating the upper limit of the usable bandwidth. On the other hand, the edge 312 is formed of foamed rubber, a high molecular weight elastomer, or the like, which have enhanced flexibility. Thus, the lowest resonant frequency $F_0$ is lowered in the vibration system 350, thereby lowering the lower limit of the usable bandwidth. As a result, the usable bandwidth is substantially enlarged.

In addition, as described above, in the edge 312, the thickness of the deepest portion 357 is less than the thickness of the base portion 358 in the roll shape. Thus, the edge 312 may have a force displacement characteristic that the deepest portion 357 of the roll shape is mainly deformed in a range in which the vibration amplitude of the diaphragm 211 is small, and the base portion 358 of the roll shape is gradually deformed in accordance with the vibration amplitude being increased. As a result, the edge 312 can have the force displacement characteristic representing improved linearity while the reduced rigidity is realized. Furthermore, the base portion 358 (thicker portion) of the roll shape is gradually deformed in accordance with the vibration amplitude being increased, and this means that the edge 312 has an enhanced flexibility resistance.

Moreover, when the projection 356 is formed as shown in the enlarged view (b) of FIG. 25, the projection 356 easily dams up and keeps an adhesive which is used to adhere the voice coil 115 (not shown) to the diaphragm 211. Thus, it is possible to prevent change of the lowest resonance frequency $F_0$ and generation of an abnormal sound which are caused by the adhesive flowing into the rolled section of the edge 312.

As described above, in the speaker 300 according to the third embodiment, enlargement of the usable bandwidth can be increased, and a speaker can have an enhanced reliability, in addition to the effect of the speaker 200 of the second embodiment being exerted.

In the above description, the speaker 300 includes the diaphragm 211 having the reinforcing ribs. However, the speaker 300 may include the diaphragm 111 having no reinforcing rib.

Figure 26:
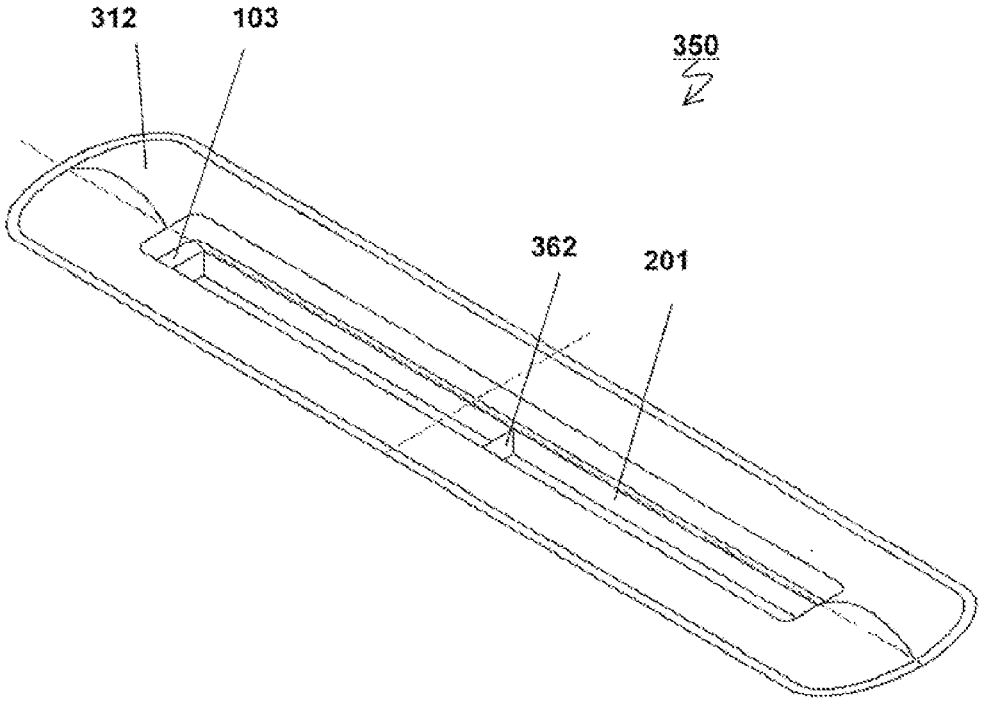
FIG. 26 is a diagram showing that a connection wall 362 is provided inside a recessed portion of the box-shaped five face body 201 in the vibration system 350 of the speaker 300.
Figure 27:
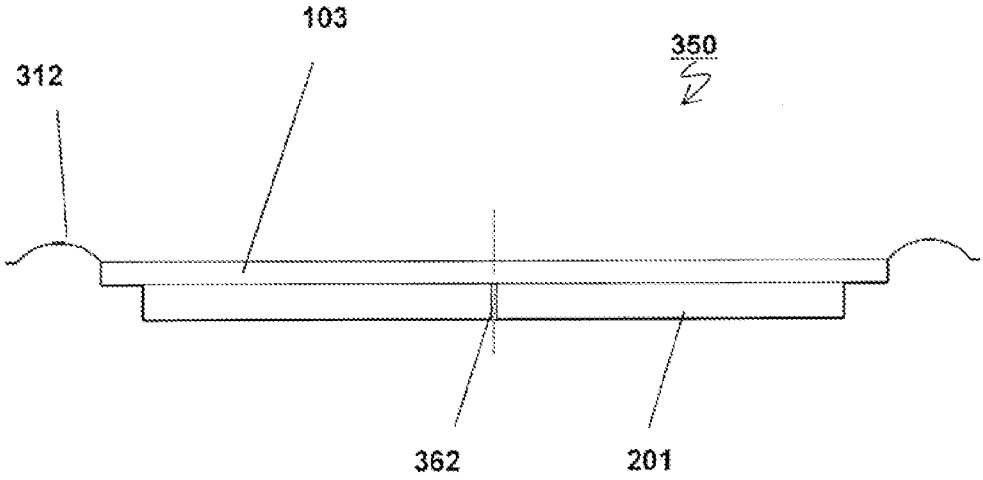
FIG. 27 is a cross-sectional view of the vibration system 350 shown in FIG. 26.
Figure 28:
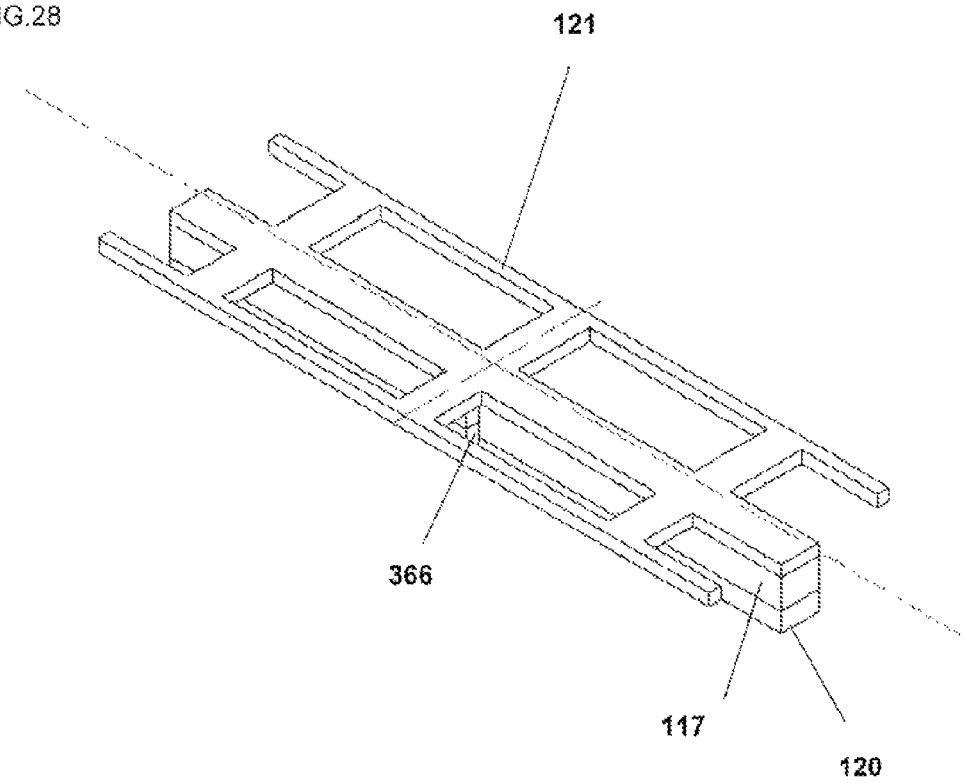
FIG. 28 is a perspective view of a lower portion of a magnetic circuit used when the connection wall 362 is used for a speaker adapted to emit a sound and voice from the bottom side as shown in FIG. 11.
Figure 29:
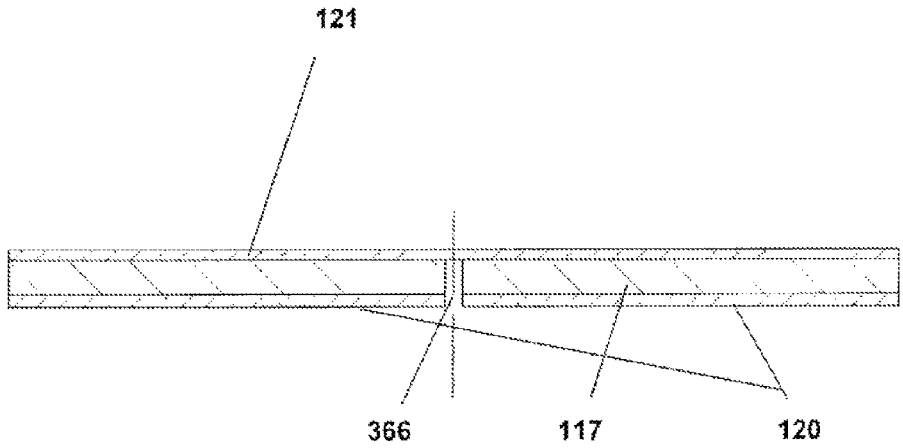
FIG. 29 is a cross-sectional view of the lower portion of the magnetic circuit shown in FIG. 28.

Further, in the speaker 300, a connection wall 362 may be provided inside a recessed portion of the box-shaped five face body 201. FIG. 26 is a diagram showing that the connection wall 362 is provided inside the recessed portion of the box-shaped five face body 201 in the vibration system 350 of the speaker 300. FIG. 27 is a cross-sectional view of the vibration system 350 shown in FIG. 26. For example, the connection wall 362 is shaped so as to connect three faces parallel to the long side direction, to each other, at the center of the box-shaped five face body 201. Further, the connection wall 362 is preferably formed so as to have the height which is equivalent to the depth of the recessed portion of the box-shaped five face body 201. The provision of the connection wall 362 enables increased enhancement of the rigidity of the diaphragm 211. The speakers according to the other embodiments may similarly include the connection wall. However, the speaker 300 according to the third embodiment is formed such that the diaphragm 211 and the edge 312 are separately formed, and therefore the connection wall can be provided, in the production of the speaker 300, with enhanced ease, as compared to in the speakers of the other embodiments. When the connection wall 362 is provided, the magnetic circuit needs to have a divided structure so as to prevent contact between the connection wall 362 and the magnetic circuit. An exemplary case in which the connection wall 362 described above is used for a speaker which is configured to emit a sound and voice from the reverse side as shown in FIG. 11 will be described. FIG. 28 is a perspective view of the lower portion of the magnetic circuit used in this exemplary case. FIG. 29 is a cross-sectional view of the lower portion of the magnetic circuit shown in FIG. 28. As shown in FIG. 28 and FIG. 29, a gap 366 is formed in the lower magnet 117 and the lower plate 120 so as to prevent contact with the connection wall 362.

Fourth Embodiment

A speaker 400 according to a fourth embodiment has a distinguished feature that a damper for suppressing rolling of a diaphragm is provided, in addition to the features of the speakers 100 to 300 according to the first to the third embodiments, respectively. Difference from the speaker 200 according to the second embodiment will be mainly described below as an example. The components which are the same between the speaker 200 of the second embodiment and the speaker 400 of the fourth embodiment are denoted by the same corresponding reference numerals, and the description thereof is not basically given.

Figure 30:
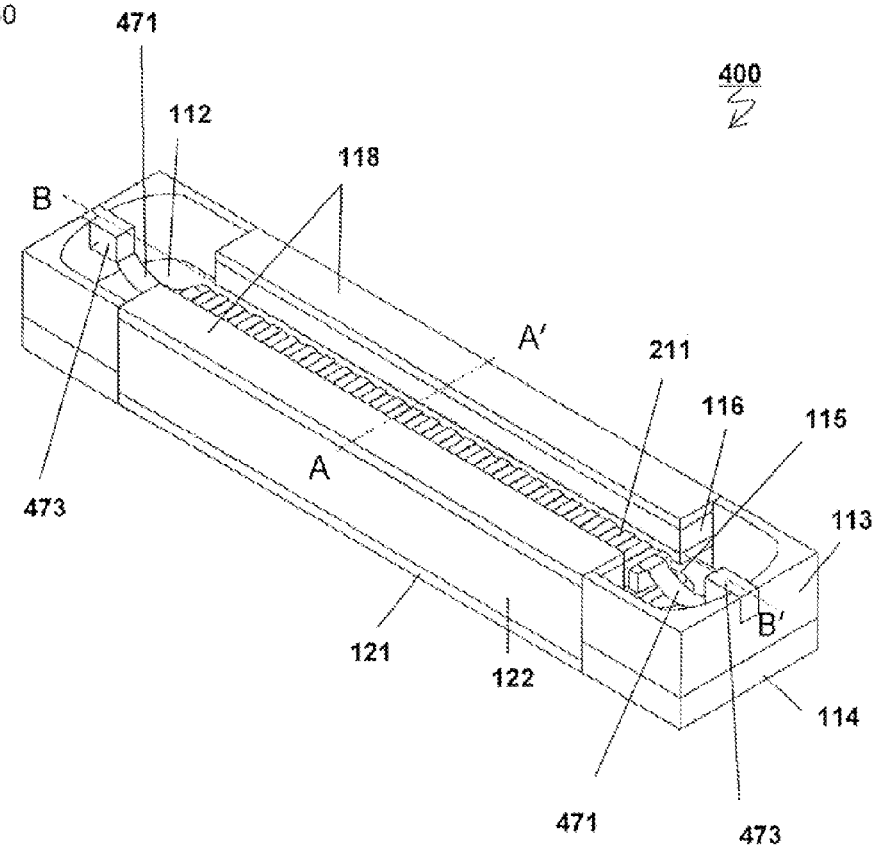
FIG. 30 is a perspective view of a speaker 400 according to a fourth embodiment.
Figure 31:
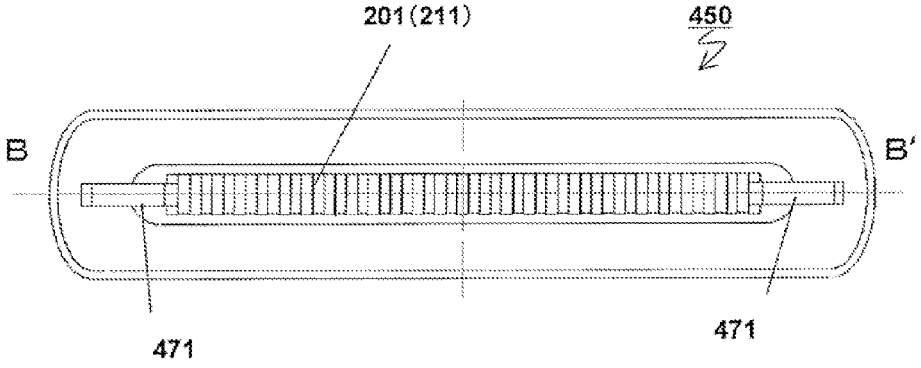
FIG. 31 is a plan view of a vibration system 450 of the speaker 400 shown in FIG. 30.
Figure 32:
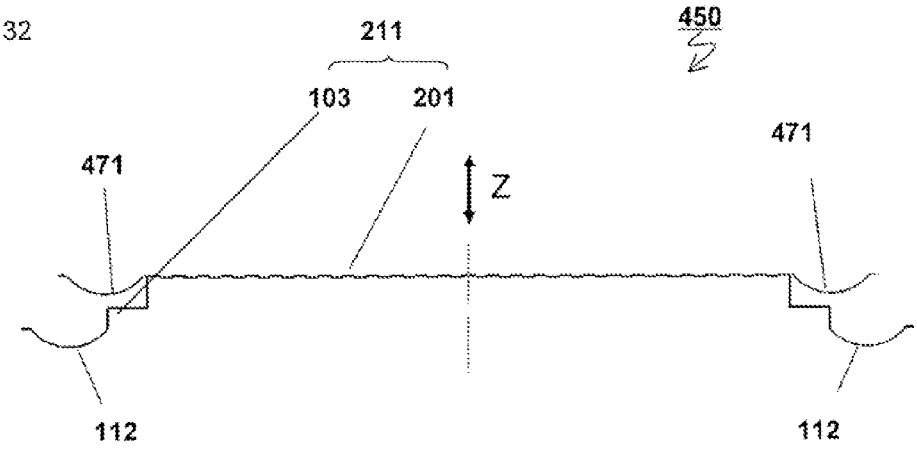
FIG. 32 is a diagram illustrating a cross section of the vibration system 450 shown in FIG. 31 along B-B'.

FIG. 30 is a perspective view of the speaker 400 according to the fourth embodiment. FIG. 31 is a plan view of a vibration system 450 of the speaker 400 shown in FIG. 30. FIG. 32 is a diagram illustrating a cross section of the vibration system 450 shown in FIG. 31 along B-B'. As shown in FIG. 30 to FIG. 32, the speaker 400 includes dampers 471, and one end of each damper 471 is attached to a corresponding one of both end portions of the upper face of the box-shaped five face body 201 of the diaphragm 211 in the long side direction. Each damper 471 is roll-shaped, and has an almost semicircular (arc-shaped) cross section, as shown in FIG. 32. The other end of each damper 471 is attached to a corresponding one of damper bases 473 provided on the upper frames 113, as shown in FIG. 30. Each damper base 473 may be formed as an extended portion of a corresponding one of the upper frames 113. As a material of the dampers 471, a component formed by a fabric being impregnated with a phenolic resin and hardened, a polymer film, a thin sheet formed of, for example, a foamed rubber or a viscoelastic component, or the like is used.

As shown in FIG. 32, the diaphragm 211 is supported by the edge 112 and the dampers 471 so as to be able to vibrate in the Z direction. More specifically, the diaphragm 211 is supported by the dampers 471 on the both end portions of the upper face of the box-shaped five face body 201 in the long side direction, and is supported by the edge 112 on the outer periphery lower portion of the inverse-L-shaped flange 103. Thus, the diaphragm 211 is spatially supported, so that the rolling of the diaphragm 211 can be effectively suppressed. As a result, in the speaker 400 according to the fourth embodiment, the diaphragm 211 vibrates only in the Z direction shown in FIG. 32, thereby realizing reproduction of a sound and voice with enhanced quality.

Figure 33:
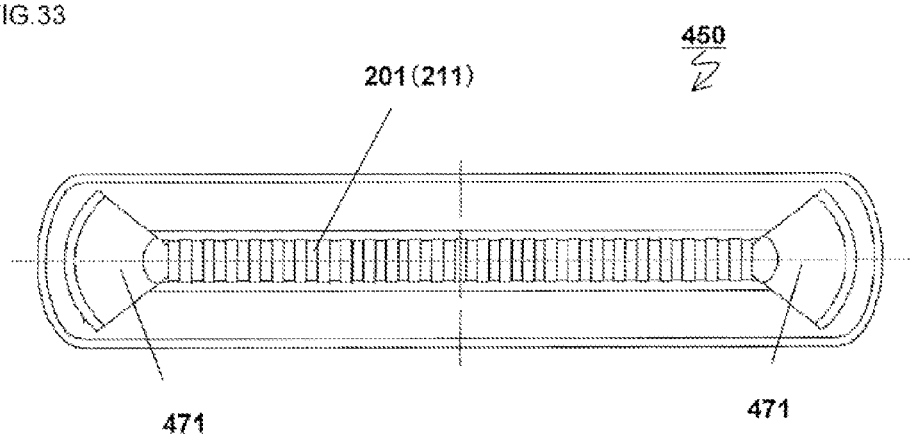
FIG. 33 is a plan view of another example of the vibration system 450 of the speaker 400 shown in FIG. 30.
Figure 34:
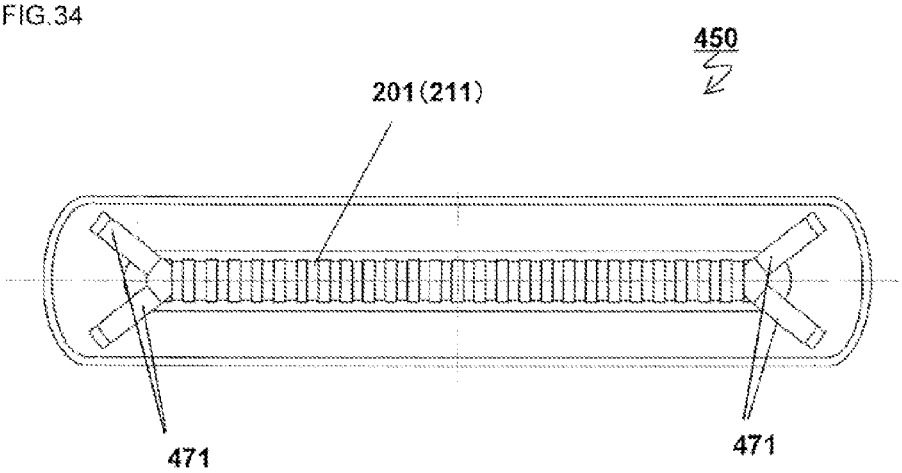
FIG. 34 is a plan view of still another example of the vibration system 450 of the speaker 400 shown in FIG. 30.
Figure 35:
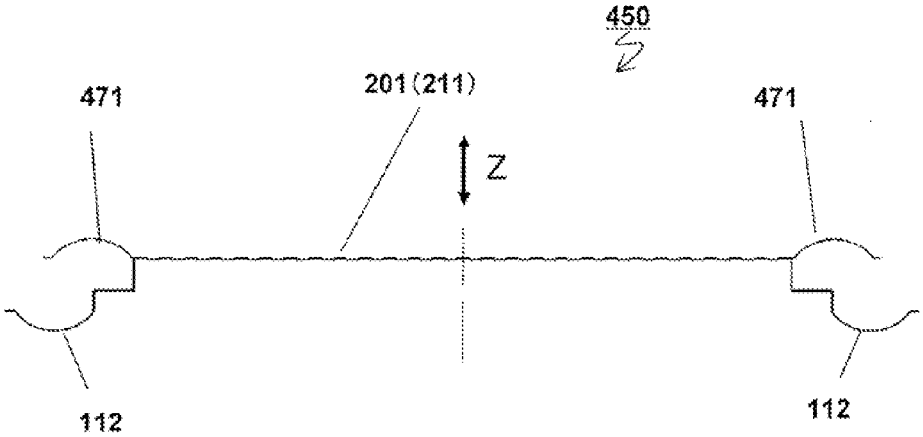
FIG. 35 is a cross-sectional view of another example of the vibration system 450 of the speaker 400 shown in FIG. 30.

The shape of the dampers 471 is not limited to a rolled rectangular shape as shown in FIG. 30 to FIG. 32. Each damper 471 may have, for example, a rolled sector shape as shown in FIG. 33. Further, for example, as shown in FIG. 34, the diaphragm 211 may be supported, by a plurality of the dampers 471 which are radially connected to each other, on each of both the end portions of the upper face of the box-shaped five face body 201 in the long side direction. The damper having a structure shown in FIG. 33 or FIG. 34 enables the rolling of the diaphragm 211 to be suppressed with enhanced effectiveness. Further, the rolling directions of the dampers 471 may be reversed as shown in FIG. 35 which is a cross-sectional view of the vibration system 450, and in this case, the same effect can be obtained (see FIG. 32).

Figure 36:
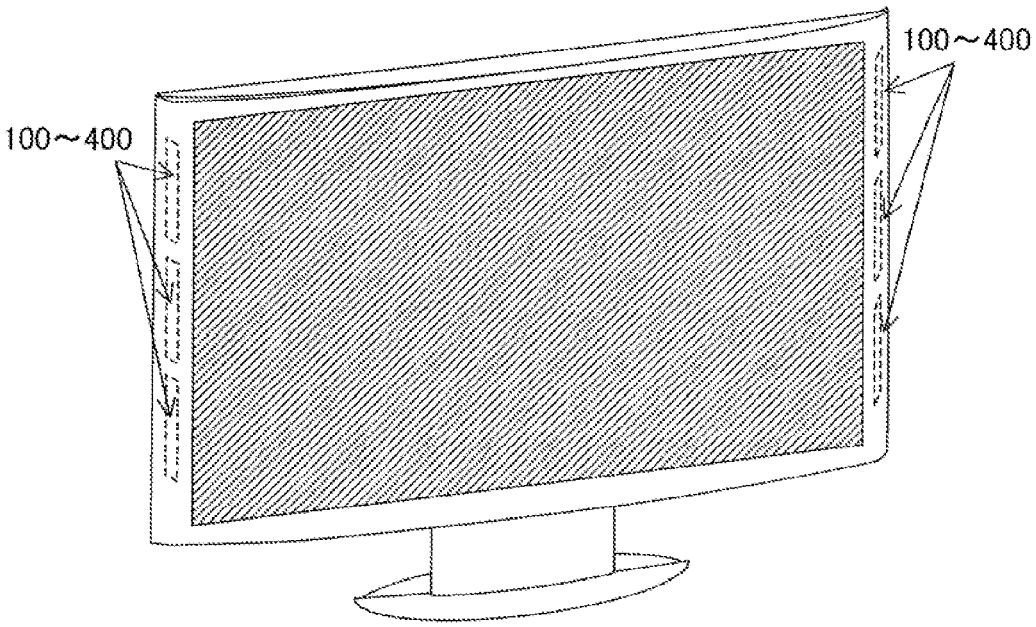
FIG. 36 is a diagram illustrating a thin-screen television including a speaker of the present invention.

The speaker according to each embodiment described above is not only capable of outputting a high quality sound, but also is easily formed so as to become slim and to have its thickness reduced. Therefore, as shown in FIG. 36, the speaker can be effectively mounted to a thin-screen television (thin-screen television broadcast receiver). Similarly, the speaker can be effectively mounted to an electronic equipment such as a mobile telephone or a PDA.

The present invention is useful as a speaker or the like, and is particularly useful when a sound and voice needs to be reproduced with high quality by a slim-type speaker.

The invention claimed is:

1. A speaker, comprising:

a diaphragm formed as an elongated box-shape having a five face body and one open face disposed opposite an upper face of the five face body;

at least one damper, connected to the upper face opposed to the open face of the diaphragm, for supporting the diaphragm so as to enable vibration of the diaphragm;

a flange provided on four side faces of the diaphragm, the four side faces being adjacent to the open face of the diaphragm;

an edge joined to the flange so as to form a projection portion on the flange;

a voice coil wound around the four side faces which are among the five faces of the diaphragm and which are adjacent to the open face, the voice coil being fixed to the diaphragm and the flange and disposed on an opposite end of the diaphragm with respect to the at least one damper;

a plurality of reinforcing ribs formed, in a configuration where the upper face and two side faces of the diaphragm define a long side direction of the diaphragm, on the diaphragm as continuous recessed and projecting shapes which are formed on the upper face and the two side faces of the diaphragm; and a magnetic circuit for supplying a drive force to the voice coil, wherein the diaphragm is configured such that a height from the open face to the upper face opposed to the open face is greater than or equal to twice a thickness of the voice coil, and a length of a long side of the upper face is greater than or equal to twice a length of a short side of the upper face.

2. The speaker according to claim 1, wherein at least one connection wall is provided inside the diaphragm.

3. The speaker according to claim 1, wherein the edge is formed of a sheet having a cross section of an arc shape, and a thickness of the edge is gradually increased from a center of the arc shape toward end portions of the arc shape.

4. The speaker according to claim 1, wherein the edge is made of a material different from a material of the diaphragm.

5. The speaker according to claim 4, wherein the edge is formed of a foamed rubber or a high molecular weight elastomer, and the diaphragm is formed of a polyimide resin or a pulp.

6. The speaker according to claim 1, wherein the magnetic circuit includes one inner magnetic pole having a rectangular parallelepiped shape, and two outer magnetic poles each having a rectangular parallelepiped shape, the one inner magnetic pole is disposed adjacent to the open face of the diaphragm, and the two outer magnetic poles are disposed lateral to both sides, respectively, of the diaphragm.

7. The speaker according to claim 1, wherein the edge is connected to end portions of the four side faces adjacent to the open face of the diaphragm to support the diaphragm, and the end portions are adjacent to the open face of the diaphragm.

8. The speaker according to claim 7, wherein the at least one damper is formed of a sector-shaped sheet having an arc-shaped cross section.

9. The speaker according to claim 7, wherein the at least one damper is formed of a rectangular sheet having an arc-shaped cross section.

10. The speaker according to claim 9, further comprising a plurality of dampers, each connected to the upper face opposed to the open face of the diaphragm, for supporting the diaphragm so as to enable vibration of the diaphragm, wherein the plurality of dampers support the diaphragm such that at least two of the plurality of dampers each have one end portion connected to the upper face opposed to the open face of the diaphragm at a same one position, and each have the other end portion oriented toward a different direction.

11. An electronic equipment comprising the speaker according to claim 1.

12. A television broadcast receiver comprising the speaker according to claim 1.

13. The speaker according to claim 1, wherein in a vibration system which includes the diaphragm, the flange, and the edge, the length of a driven portion of the diaphragm is at least 60% of an entire length of the vibration system in the long side direction.

* * * * *